US012480258B2

(12) United States Patent
McKee et al.

(10) Patent No.: US 12,480,258 B2
(45) Date of Patent: Nov. 25, 2025

(54) LAYERED FIBROUS STRUCTURES

(71) Applicant: The Procter & Gamble Company, Cincinnati, OH (US)

(72) Inventors: Matthew Gary McKee, Cincinnati, OH (US); Timothy James Klawitter, North Bend, OH (US); Patricia Callanan Thomas, Wyoming, OH (US); Mark Charles Rueve, North Bend, OH (US); Robert Howard Scholle, Lawrenceburg, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 197 days.

(21) Appl. No.: 18/152,877

(22) Filed: Jan. 11, 2023

(65) Prior Publication Data

US 2023/0220630 A1 Jul. 13, 2023

Related U.S. Application Data

(60) Provisional application No. 63/299,130, filed on Jan. 13, 2022.

(51) Int. Cl.

| | |
|---|---|
| ***D21H 27/38*** | (2006.01) |
| ***D21F 11/04*** | (2006.01) |
| ***D21H 13/16*** | (2006.01) |
| ***D21H 13/30*** | (2006.01) |
| ***D21H 21/16*** | (2006.01) |
| ***D21H 21/22*** | (2006.01) |
| ***D21H 27/00*** | (2006.01) |
| ***D21H 27/40*** | (2006.01) |

(52) U.S. Cl.

CPC ..... *D21H 27/38* (2013.01); *D21F 11/04* (2013.01); *D21H 13/16* (2013.01); *D21H 13/30* (2013.01); *D21H 21/16* (2013.01); *D21H 21/22* (2013.01); *D21H 27/008* (2013.01); *D21H 27/40* (2013.01)

(58) Field of Classification Search

CPC ..... D21H 27/38; D21H 13/16; D21H 13/30; D21H 21/16; D21H 21/22; D21H 27/008; D21H 27/40; D21H 27/002; D21H 27/005; D21H 27/30; D21F 11/04

See application file for complete search history.

(56) References Cited

U.S. PATENT DOCUMENTS

| | | | | |
|---|---|---|---|---|
| 11,220,790 | B2 * | 1/2022 | Cabell | D21H 27/38 |
| 2018/0105992 | A1 | 4/2018 | Young et al. | |
| 2018/0209101 | A1 * | 7/2018 | Cabell | D21F 11/16 |

* cited by examiner

*Primary Examiner* — Jacob T Minskey
*Assistant Examiner* — Elisa H Vera
(74) *Attorney, Agent, or Firm* — James E. Oehlenschlager

(57) ABSTRACT

Layered fibrous structures and methods for making same are provided.

17 Claims, 7 Drawing Sheets

LAYERED FIBROUS STRUCTURES

FIELD OF THE INVENTION

The present invention relates to fibrous structures, and more particularly to layered fibrous structures comprising filaments and a surface softening composition and methods for making same.

BACKGROUND OF THE INVENTION

Creating fibrous structures, for example sanitary tissue products, that have both good surface softness and bulk/absorbency can be challenging. Structured fibrous structure making processes, for example a through-air-drying process, can be used to enable bulk and caliper generation in wet laid fibrous structures; however, the consumer-contacting surface of such structured wet laid fibrous structures can feel rough and undesirable to consumers due to relatively coarse fibers (as compared to filaments) and/or as a result of the relatively highly textured consumer-contacting surface.

Formulators of such fibrous structures have modified their making processes to attempt to overcome these negatives. One way the formulators have overcome this contradiction is to layer a short, soft cellulose fiber, such as eucalyptus, in the consumer-contacting surface of the fibrous structure, however due to weak bonding these short, soft cellulosic fibers easily release from the consumer-contacting surface of the fibrous structure and create high lint which is a consumer negative. Another way formulators have tried to create fibrous structures that exhibit both high softness and bulk is to apply a surface softening composition, for example a quaternary ammonium softening agent and/or a lotion to the consumer-contacting surface of a coarse, highly textured cellulosic fibrous structure. However, uniform coverage of surface softening compositions on textured cellulosic fibrous structures, such as structured fibrous structures useful in sanitary tissue product is difficult to achieve due to differences in topography of the textured consumer-contacting surface, for example between low density (sometimes referred to as pillows) and high-density (sometimes referred to as knuckles) regions of the textured consumer-contacting surface. In one example, when the consumer-contacting surface is the wire side out (WSO) surface (side of fibrous structure that contacts the forming wire during a wet laid fibrous structure making operation), any surface softening composition applied to the consumer-contacting surface is preferentially applied to any protruding regions (for example knuckle regions) of the consumer-contacting surface. In another example, when the consumer-contacting is the fabric side out (FSO) surface (side of fibrous structure that contacts a molding member, for example a structuring belt, such as a through-air-drying belt, any surface softening composition is preferentially applied to the protruding regions (for example pillow regions) of the consumer-contacting surface. However, in neither case is the surface softening composition evenly applied to both the knuckle regions and the pillow regions of a consumer-contacting surface. This results in lower concentration of surface softening composition being available to the consumer during use, and a less than complete satisfactory experience from a softness standpoint. This disparity in surface coverage of the surface softening composition between different regions (protruding and recessed regions for example) of the consumer-contacting surface becomes even greater as the texture, coarseness, and bulk of the fibrous structure increases.

Formulators have tried to overcome the negatives of less than satisfactory coverage of surface softening compositions on fibrous structures, for example structured fibrous structure, by depositing starch and/or starch derivative filaments at a relatively high basis weight; namely, greater than 5 gsm and/or greater than 6 gsm and/or greater than 10 gsm onto the fibrous structure, for example the structured fibrous structure, to create the consumer-contacting surface. Unfortunately, this approach has its own negatives, for example a slimy consumer feel and/or prohibitive costs implications, for example due to die throughput requirements and/or capital/equipment requirements.

In light of the foregoing, one problem with known fibrous structures is the inability to achieve consumer desirable softness and/or bulk and/or absorbency in fibrous structures, such as structured fibrous structures useful in sanitary tissue products without the negatives associated with known fibrous structures.

Thus, there is a need for fibrous structures, for example structured fibrous structures, that exhibit improved softness and/or bulk and/or absorbency compared to known fibrous structures, for example known structured fibrous structures, such as known through-air-dried fibrous structures.

SUMMARY OF THE INVENTION

The present invention fulfills the need described above by providing a fibrous structure, for example a structured fibrous structure, such as a through-air-dried fibrous structure that exhibits improved softness and/or bulk and/or absorbency without the negatives associated with known fibrous structures.

One solution to the problem described above, is to form a consumer-contacting surface of a plurality of filaments, for example hydroxyl polymer filaments such as starch and/or starch derivative filaments and/or polyvinyl alcohol (PVOH) spun directly onto a surface of a fibrous structure, for example a structured fibrous structure, such as a through-air-dried fibrous structure, and then applying a surface softening composition to the plurality of filaments such that the resulting fibrous structure exhibits improved softness and/or bulk and/or absorbency and/or lower lint than known fibrous structures.

Deposition of a surface softening composition onto a consumer-contacting surface of a textured cellulosic fibrous structure requires the surface softening composition, in the form of a liquid, to contact the consumer-contacting surface of the fibrous structure. Due to the unevenness of the consumer-contacting surface of the fibrous structure, for example a structured fibrous structure, such as a through-air-dried fibrous structure that oftentimes is composed of discrete low density regions (pillow regions) and high density regions (knuckle regions), uniform surface softening composition deposition is difficult to achieve which can negatively impact the surface feel and thus softness of the fibrous structure. A problem that has not been addressed is how to create structured fibrous structure that exhibit good softness, bulk, thickness, and absorbency while maintaining a consumer-contacting surface that enables even and/or substantially complete and/or complete application of a surface softening composition. The addition of a low gsm, for example 2.5 gsm or less, flat and/or substantially flat and/or monoplanar and/or substantially monoplanar and/or uniform and/or substantially uniform layer of filaments, for example starch and/or starch derivative and/or polyvinyl alcohol filaments applied to the structured fibrous structure creates an even and/or substantially even and/or flat and/or substantially flat and/or monoplanar and/or substantially monoplanar surface upon which a surface softening composition is deposited, for example by way of a slot extruder. Without wishing to be bound by theory, this novel consumer-contacting surface is created because the continuous filaments can span the textured, for example low-density regions (pillow regions) of the structured fibrous structure and/or high-density regions (knuckle regions) of the structured fibrous structure providing a smooth canvass for surface softening composition application. The resulting fibrous structure of the present invention has a unique combination of texture and surface softness, for example TS7 values of less than 12 and/or less than 10 and/or less than 9 and/or less than 8 and/or less than 7 and/or less than 6 and/or less than 5 and/or greater than 1 as measured according to the Emtec Test Method described herein.

In one example of the present invention, a layered fibrous structure comprising:

a. a first layer comprising a plurality of fibrous elements, wherein the first layer comprises a surface;
b. a second layer comprising a plurality of filaments spun directly onto the surface of the first layer, wherein the plurality of filaments are present on the surface of the first layer at a basis weight of 2.5 gsm or less; and
c. a surface softening composition present on at least a portion of the plurality of filaments, is provided.

In another example of the present invention, a layered fibrous structure comprising:

a. a first layer comprising a plurality of fibrous elements; and
b. a second layer comprising a plurality of filaments spun directly onto a surface of the first layer, wherein the plurality of filaments are present on the surface of the first layer at a level of 2.5 gsm or less, wherein the second layer forms an exterior surface of the layered fibrous structure, wherein the exterior surface comprises a surface softening composition, is provided.

In another example of the present invention, a layered fibrous structure comprising:

a. a first layer comprising a plurality of pulp fibers; and
b. a second layer comprising a plurality of filaments spun directly onto a surface of the first layer, wherein the plurality of filaments are present on the surface of the first layer at a level of 2.5 gsm or less, wherein the second layer forms an exterior surface of the layered fibrous structure, wherein the exterior surface comprises a surface softening composition, is provided.

In still another example of the present invention, a single- or multi-ply sanitary tissue product, for example a toilet tissue, comprising a layered fibrous structure according to the present invention, is provided.

In still another example of the present invention, a method for making a layered fibrous structure according to the present invention comprises the steps of:

a. providing a first layer, for example a fibrous structure;
b. spinning a plurality of filaments onto a surface of the first layer to form a second layer; and
c. applying a surface softening composition onto the plurality of filaments to form a layered fibrous structure wherein the surface softening composition forms an exterior surface of the layered fibrous structure, is provided.

Accordingly, the present invention provides layered fibrous structures and methods for making same.

DETAILED DESCRIPTION OF THE INVENTION

Definitions

Figure 1:
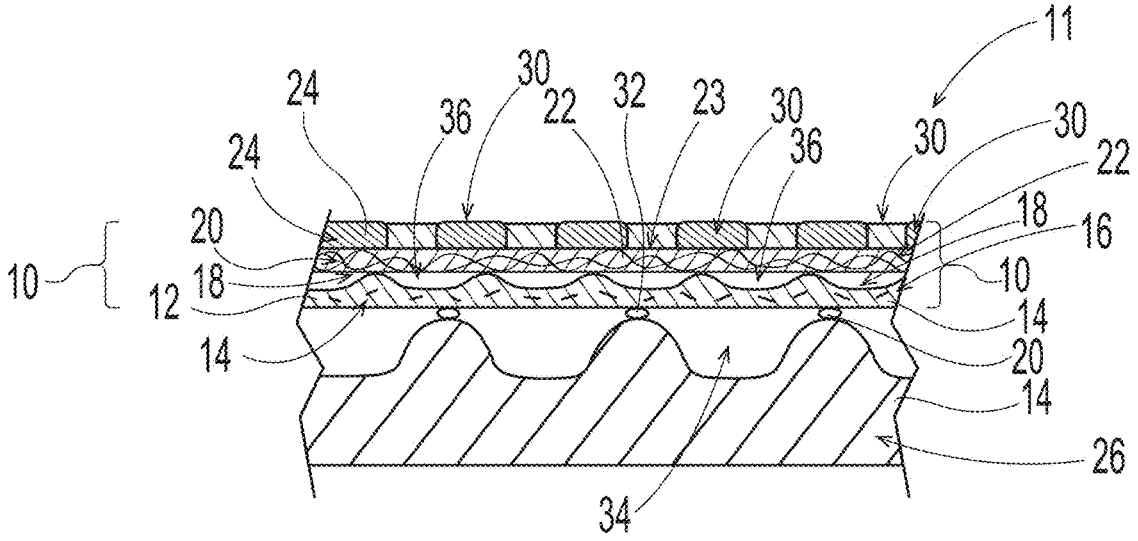
FIG. 1 is a cross-section representation of an example of a multi-ply fibrous structure comprising a layered fibrous structure according to the present invention.

"Fibrous element" as used herein means an elongate particulate having a length greatly exceeding its average diameter, i.e. a length to average diameter ratio of at least about least about 10 and/or at least about 100 and/or at least about 1000 and/or up to 5000. A fibrous element may be a filament or a fiber. In one example, the fibrous element is a single fibrous element rather than a yarn comprising a plurality of fibrous elements.

The fibrous elements of the present invention may be spun from polymer melt compositions via suitable spinning operations, such as meltblowing and/or spunbonding and/or they may be obtained from natural sources such as vegetative sources, for example trees.

The fibrous elements of the present invention may be monocomponent and/or multicomponent. For example, the fibrous elements may comprise bicomponent fibers and/or filaments. The bicomponent fibers and/or filaments may be in any form, such as side-by-side, core and sheath, islands-in-the-sea and the like.

"Filament" as used herein means an elongate particulate as described above that exhibits a length of greater than or equal to 5.08 cm (2 in.) and/or greater than or equal to 7.62 cm (3 in.) and/or greater than or equal to 10.16 cm (4 in.) and/or greater than or equal to 15.24 cm (6 in.). The filament may exhibit a length to average diameter ratio of at least about 100 and/or at least about 1000 and/or up to 5000.

Filaments are typically considered continuous or substantially continuous in nature. Filaments are relatively longer than fibers. Non-limiting examples of filaments include meltblown and/or spunbond filaments. Non-limiting examples of polymers that can be spun into filaments include natural polymers, such as starch, starch derivatives, cellulose, such as rayon and/or lyocell, and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments, polyesteramide filaments, and polycaprolactone filaments. The filaments may be monocomponent or multicomponent, such as bicomponent filaments.

In one example, the filaments, for example the starch filaments and/or the polyvinyl alcohol filaments, of the present invention exhibit an Average Fiber Diameter of less than 7 μm and/or less than 6 μm and/or less than 5 μm and/or less than 4 μm and/or less than 3 μm as measured according to the Average Diameter Test Method described herein.

"Fiber" as used herein means an elongate particulate as described above that exhibits a length of less than 5.08 cm (2 in.) and/or less than 3.81 cm (1.5 in.) and/or less than 2.54 cm (1 in.). The fiber may exhibit a length to average diameter ratio of less than 100 and/or less than about 50 and/or less than about 25 and/or about 10.

Fibers are typically considered discontinuous in nature. Non-limiting examples of fibers include pulp fibers, such as wood pulp fibers, and synthetic staple fibers such as polypropylene, polyethylene, polyester, copolymers thereof, rayon, lyocell, glass fibers and polyvinyl alcohol fibers.

Staple fibers may be produced by spinning a filament tow and then cutting the tow into segments of less than 5.08 cm (2 in.) thus producing fibers; namely, staple fibers.

In one example of the present invention, a fiber may be a naturally occurring fiber, which means it is obtained from a naturally occurring source, such as a vegetative source, for example a tree and/or plant, such as trichomes. Such fibers are typically used in papermaking and are oftentimes referred to as papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to fibrous structures made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present invention are fibers derived from recycled paper, which may contain any or all of the above categories of fibers as well as other non-fibrous polymers such as fillers, softening agents, wet and dry strength agents, and adhesives used to facilitate the original papermaking.

In one example, the wood pulp fibers are selected from the group consisting of hardwood pulp fibers, softwood pulp fibers, and mixtures thereof. The hardwood pulp fibers may be selected from the group consisting of: tropical hardwood pulp fibers, northern hardwood pulp fibers, and mixtures thereof. The tropical hardwood pulp fibers may be selected from the group consisting of: eucalyptus fibers, acacia fibers, and mixtures thereof. The northern hardwood pulp fibers may be selected from the group consisting of: cedar fibers, maple fibers, and mixtures thereof.

In addition to the various wood pulp fibers, other cellulosic fibers such as cotton linters, rayon, lyocell, trichomes, seed hairs, and bagasse fibers can be used in this invention. Other sources of cellulose in the form of fibers or capable of being spun into fibers include grasses and grain sources.

"Trichome" or "trichome fiber" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristle-like outgrowth from the epidermis of a plant.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Fibrous structure" as used herein means a structure that comprises a web material comprising a plurality of fibrous elements, for example a plurality of fibers, such as a plurality of pulp fibers, such as wood pulp fibers and/or non-wood pulp fibers, for example plant fibers, synthetic staple fibers, and mixtures thereof. In addition to pulp fibers, the web material may comprise a plurality of filaments, such as polymeric filaments, for example thermoplastic filaments such as polyolefin filaments (i.e., polypropylene filaments), polyester filament, polyethylene terephthalate (PET) filaments and/or hydroxyl polymer filaments, for example polyvinyl alcohol filaments and/or polysaccharide filaments such as starch filaments, such as in the form of a coform web material where the fibers and filaments are commingled together and/or are present as discrete or substantially discrete layers within the web material. A web material according to the present invention means an orderly arrangement of fibers alone and/or with filaments within a structure in order to perform a function. A fibrous structure according to the present invention means an association of fibrous elements that together form a structure capable of performing a function. A fibrous structure may comprise a plurality of inter-entangled fibrous elements, for example inter-entangled filaments. Non-limiting examples of web materials of the present invention include paper.

Non-limiting examples of processes for making the web material of the fibrous structures of the present invention include known wet-laid papermaking processes, for example conventional wet-pressed (CWP) papermaking processes and structure paper-making processes, for example through-air-dried (TAD), both creped TAD and uncreped TAD, papermaking processes, fabric-creped papermaking processes, belt-creped papermaking processes, ATMOS papermaking processes, NTT papermaking processes, and air-laid papermaking processes. Such processes typically include steps of preparing a fiber composition in the form of a fiber suspension in a medium, either wet, more specifically aqueous medium, or dry, more specifically gaseous, i.e. with air as medium. The aqueous medium used for wet-laid processes is oftentimes referred to as a fiber slurry. The fiber slurry is then used to deposit a plurality of the fibers onto a forming wire, fabric, or belt such that an embryonic web material is formed, after which drying and/or bonding the fibers together results in a web material, for example the web material. Further processing of the web material may be carried out such that a finished web material is formed. For example, in typical papermaking processes, the finished web material is the web material that is wound on the reel at the end of papermaking, often referred to as a parent roll, and may subsequently be converted into a finished fibrous structure of the present invention, e.g. a single- or multi-ply fibrous structure and/or a single- or multi-ply toilet tissue.

The web material is a coformed web material comprising a plurality of filaments and a plurality of fibers commingled together as a result of a coforming process.

"Basis Weight" as used herein is the weight per unit area of a sample reported in lbs/3000 $ft^2$ or $g/m^2$ (gsm) and is measured according to the Basis Weight Test Method described herein.

"Machine Direction" or "MD" as used herein means the direction parallel to the flow of the fibrous structure through the fibrous structure making machine and/or toilet tissue manufacturing equipment.

"Cross Machine Direction" or "CD" as used herein means the direction parallel to the width of the fibrous structure making machine and/or toilet tissue manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply toilet tissue. It is also contemplated that an individual, integral fibrous structure can effectively form a multi-ply fibrous structure, for example, by being folded on itself.

"Embossed" as used herein with respect to a web material, a fibrous structure, and/or a toilet tissue means that a web material, a fibrous structure, and/or a toilet tissue has been subjected to a process which converts a smooth surfaced web material, fibrous structure, and/or toilet tissue to a decorative surface by replicating a design on one or more emboss rolls, which form a nip through which the web material, fibrous structure, and/or toilet tissue passes. Embossed does not include creping, microcreping, printing or other processes that may also impart a texture and/or decorative pattern to a web material, a fibrous structure, and/or a toilet tissue.

"Differential density", as used herein, means a web material that comprises one or more regions of relatively low fiber density, which are referred to as pillow regions, and one or more regions of relatively high fiber density, which are referred to as knuckle regions.

"Densified", as used herein means a portion of a fibrous structure and/or toilet tissue that is characterized by regions of relatively high fiber density (knuckle regions).

"Non-densified", as used herein, means a portion of a fibrous structure and/or toilet tissue that exhibits a lesser density (one or more regions of relatively lower fiber density) (pillow regions) than another portion (for example a knuckle region) of the fibrous structure and/or toilet tissue.

"Non-rolled" as used herein with respect to a fibrous structure and/or toilet tissue of the present invention means that the fibrous structure and/or toilet tissue is an individual sheet (for example not connected to adjacent sheets by perforation lines. However, two or more individual sheets may be interleaved with one another) that is not convolutedly wound about a core or itself.

"Creped" as used herein means creped off of a Yankee dryer or other similar roll and/or fabric creped and/or belt creped. Rush transfer of a fibrous structure alone does not result in a "creped" fibrous structure or "creped" toilet tissue for purposes of the present invention.

"Toilet tissue" as used herein means a soft, relatively low density fibrous structure, for example a multi-ply two or more or three or more fibrous structure plies useful as a wiping implement for post-urinary and post-bowel movement cleaning. The toilet tissue may be convolutedly wound upon itself about a core or without a core to form a toilet tissue roll (roll of toilet tissue) or may be in the form of discrete sheets. When in the form of a roll of toilet tissue, the roll of toilet tissue may exhibit a roll compressibility (% Compressibility) as measured according to the Roll Compressibility Test Method described herein of from about 4% to about 8% and/or from about 4% to about 7% and/or from about 4% to about 6%.

In one example, the toilet tissue of the present invention comprises one or more fibrous structures according to the present invention.

The toilet tissue and/or fibrous structures of the present invention making up the toilet tissue may exhibit a basis weight between about 1 $g/m^2$ to about 5000 $g/m^2$ and/or from about 10 $g/m^2$ to about 500 $g/m^2$ and/or from about 10 $g/m^2$ to about 300 $g/m^2$ and/or from about 10 $g/m^2$ to about 120 $g/m^2$ and/or from about 15 $g/m^2$ to about 110 $g/m^2$ and/or from about 20 $g/m^2$ to about 100 $g/m^2$ and/or from about 30 to 90 $g/m^2$ as determined by the Basis Weight Test Method described herein. In addition, the toilet tissue of the present invention may exhibit a basis weight between about 10 $g/m^2$ to about 120 $g/m^2$ and/or from about 10 $g/m^2$ to about 80 $g/m^2$ and/or from about 10 to about 60 $g/m^2$ and/or from about 10 $g/m^2$ to about 55 $g/m^2$ and/or from about 20 $g/m^2$ to about 55 $g/m^2$ as determined by the Basis Weight Test Method described herein.

The toilet tissue of the present invention may exhibit a total dry tensile strength of greater than about 59 g/cm (greater than about 150 g/in) and/or greater than about 78 g/cm (greater than about 200 g/in) and/or greater than about 98 g/cm (greater than about 250 g/in) and/or greater than about 138 g/cm (greater than about 350 g/in) and/or from about 78 g/cm (about 200 g/in) to about 394 g/cm (about 1000 g/in) and/or from about 98 g/cm (about 250 g/in) to about 335 g/cm (about 850 g/in). In addition, the toilet tissue of the present invention may exhibit a total dry tensile strength of greater than about 196 g/cm (greater than about 500 g/in) and/or from about 196 g/cm (about 500 g/in) to about 394 g/cm (about 1000 g/in) and/or from about 216 g/cm (about 550 g/in) to about 335 g/cm (about 850 g/in) and/or from about 236 g/cm (about 600 g/in) to about 315 g/cm (about 800 g/in). In one example, the toilet tissue exhibits a total dry tensile strength of less than about 394 g/cm (less than about 1000 g/in) and/or less than about 335 g/cm (less than about 850 g/in).

The toilet tissue of the present invention may exhibit a density of less than 0.60 $g/cm^3$ and/or less than 0.30 $g/cm^3$ and/or less than 0.20 $g/cm^3$ and/or less than 0.15 $g/cm^3$ and/or less than 0.10 $g/cm^3$ and/or less than 0.07 $g/cm^3$ and/or less than 0.05 $g/cm^3$ and/or from about 0.01 $g/cm^3$ to about 0.20 g/cm$^3$ and/or from about 0.02 g/cm$^3$ to about 0.15 g/cm$^3$ and/or from about 0.02 g/cm$^3$ to about 0.10 g/cm$^3$.

The toilet tissue of the present invention may be in the form of toilet tissue rolls. Such toilet tissue rolls may comprise a plurality of connected, but perforated sheets of fibrous structure, that are separably dispensable from adjacent sheets.

The toilet tissue and/or fibrous structures making up the toilet tissue of the present invention may comprise additives such as softening agents, temporary wet strength agents, permanent wet strength agents, bulk softening agents, lotions, silicones, wetting agents, latexes, patterned latexes and other types of additives suitable for inclusion in and/or on toilet tissue.

"Hydroxyl polymer" as used herein includes any hydroxyl-containing polymer that can be incorporated into a filament of the present invention. In one example, the hydroxyl polymer of the present invention includes greater than 10% and/or greater than 20% and/or greater than 25% by weight hydroxyl moieties. In another example, the hydroxyl within the hydroxyl-containing polymer is not part of a larger functional group such as a carboxylic acid group.

"Chemically different" as used herein with respect to two hydroxyl polymers means that the hydroxyl polymers are at least different structurally, and/or at least different in properties and/or at least different in classes of chemicals, for example polysaccharides, such as starch, versus non-polysaccharides, such as polyvinyl alcohol, and/or at least different in their respective solubility parameters.

"Non-thermoplastic" as used herein means, with respect to a material, such as a fibrous element as a whole and/or a polymer, such as a crosslinked polymer, within a fibrous element, that the fibrous element and/or polymer exhibits no melting point and/or softening point, which allows it to flow under pressure, in the absence of a plasticizer, such as water, glycerin, sorbitol, urea and the like.

"Non-cellulose-containing" as used herein means that less than 5% and/or less than 3% and/or less than 1% and/or less than 0.1% and/or 0% by weight of cellulose polymer, cellulose derivative polymer and/or cellulose copolymer is present in fibrous element. In one example, "non-cellulose-containing" means that less than 5% and/or less than 3% and/or less than 1% and/or less than 0.1% and/or 0% by weight of cellulose polymer is present in fibrous element.

"Fast wetting surfactant" and/or "fast wetting surfactant component" and/or "fast wetting surfactant function" as used herein means a surfactant and/or surfactant component, such as an ion from a fast wetting surfactant, for example a sulfosuccinate diester ion (anion), that exhibits a Critical Micelle Concentration (CMC) of greater 0.15% by weight and/or at least 0.25% and/or at least 0.50% and/or at least 0.75% and/or at least 1.0% and/or at least 1.25% and/or at least 1.4% and/or less than 10.0% and/or less than 7.0% and/or less than 4.0% and/or less than 3.0% and/or less than 2.0% by weight.

"Polymer melt composition" or "Polysaccharide melt composition" as used herein means a composition comprising water and a melt processed polymer, such as a melt processed fibrous element-forming polymer, for example a melt processed hydroxyl polymer, such as a melt processed polysaccharide.

"Melt processed fibrous element-forming polymer" as used herein means any polymer, which by influence of elevated temperatures, pressure and/or external plasticizers may be softened to such a degree that it can be brought into a flowable state, and in this condition, may be shaped as desired.

"Melt processed hydroxyl polymer" as used herein means any polymer that contains greater than 10% and/or greater than 20% and/or greater than 25% by weight hydroxyl groups and that has been melt processed, with or without the aid of an external plasticizer. More generally, melt processed hydroxyl polymers include polymers, which by the influence of elevated temperatures, pressure and/or external plasticizers may be softened to such a degree that they can be brought into a flowable state, and in this condition, may be shaped as desired.

"Blend" as used herein means that two or more materials, such as a fibrous element-forming polymer, for example a hydroxyl polymer and a polyacrylamide are in contact with each other, such as mixed together homogeneously or non-homogeneously, within a filament. In other words, a filament formed from one material, but having an exterior coating of another material is not a blend of materials for purposes of the present invention. However, a fibrous element formed from two different materials is a blend of materials for purposes of the present invention even if the fibrous element further comprises an exterior coating of a material.

"Layered" as used herein means that a fibrous structure comprises in one example at least two visually discernible z-direction portions, for example a first layer and a second layer. The visually discernible layers may be different compositions, different textures, different colors, different properties, etc.

"Associate," "Associated," "Association," and/or "Associating" as used herein with respect to fibrous elements and/or with respect to a surface and/or surface material comprising fibrous elements, such as filaments, being associated with a fibrous structure and/or a web material and/or a layer being associated with another layer within a layered fibrous structure means combining, either in direct contact or in indirect contact, fibrous elements and/or a surface material with a web material such that a fibrous structure is formed. In other words, "layered" in this context means the fibrous structure is not made up of separate plies of fibrous structures or web materials that are laminated and/or adhesively bonded with one another to form a multi-ply fibrous structure, but rather is made up of a web material upon which a surface material (not in the form of a pre-formed web material, but rather in the form of fibrous elements, such as filaments) is deposited, directly or indirectly, onto the web material. In one example, the associated fibrous elements and/or associated surface material may be bonded to the web material, directly or indirectly, for example by adhesives and/or thermal bonds to form adhesive sites and/or thermal bond sites, respectively, within the fibrous structure. In another example, the fibrous elements and/or surface material may be associated with the web material, directly or indirectly, by being deposited onto the same web material making belt.

"Average Diameter" as used herein, with respect to a fibrous element, is measured according to the Average Diameter Test Method described herein. In one example, a fibrous element, for example a filament, of the present invention exhibits an average diameter of less than 50 μm and/or less than 25 μm and/or less than 20 μm and/or less than 15 μm and/or less than 10 μm and/or less than 6 μm and/or greater than 1 μm and/or greater than 3 μm.

"3D pattern" with respect to a fibrous structure and/or toilet tissue's surface in accordance with the present invention means herein a pattern that is present on at least one surface of the fibrous structure and/or toilet tissue. The 3D pattern texturizes the surface of the fibrous structure and/or toilet tissue, for example by providing the surface with protrusions and/or depressions. The 3D pattern on the surface of the fibrous structure and/or toilet tissue is made by making the toilet tissue or at least one fibrous structure ply employed in the toilet tissue on a patterned molding member that imparts the 3D pattern to the toilet tissue and/or fibrous structure plies made thereon.

"Water-resistant" as it refers to a surface pattern or part thereof means that a 3D pattern retains its structure and/or integrity after being saturated by water and the 3D pattern is still visible to a consumer. In one example, the 3D pattern may be water-resistant.

"Wet textured" as used herein means that a 3D patterned fibrous structure ply comprises texture (for example a three-dimensional topography) imparted to the fibrous structure and/or fibrous structure's surface during a fibrous structure making process. In one example, in a wet-laid fibrous structure making process, wet texture can be imparted to a fibrous structure upon fibers and/or filaments being collected on a collection device that has a three-dimensional (3D) surface which imparts a 3D surface to the fibrous structure being formed thereon and/or being transferred to a fabric and/or belt, such as a through-air-drying fabric and/or a patterned drying belt, comprising a 3D surface that imparts a 3D surface to a fibrous structure being formed thereon. In one example, the collection device with a 3D surface comprises a patterned, such as a patterned formed by a polymer or resin being deposited onto a base substrate, such as a fabric, in a patterned configuration. The wet texture imparted to a wet-laid fibrous structure is formed in the fibrous structure prior to and/or during drying of the fibrous structure. Non-limiting examples of collection devices and/or fabric and/or belts suitable for imparting wet texture to a fibrous structure include those fabrics and/or belts used in fabric creping and/or belt creping processes, for example as disclosed in U.S. Pat. Nos. 7,820,008 and 7,789,995, coarse through-air-drying fabrics as used in uncreped through-air-drying processes, and photo-curable resin patterned through-air-drying belts, for example as disclosed in U.S. Pat. No. 4,637,859. Wet texture is different from non-wet texture that is imparted to a fibrous structure after the fibrous structure has been dried, for example after the moisture level of the fibrous structure is less than 15% and/or less than 10% and/or less than 5%. An example of non-wet texture includes embossments imparted to a fibrous structure by embossing rolls during converting of the fibrous structure.

As used herein, the articles "a" and "an" when used herein, for example, "an anionic surfactant" or "a fiber" is understood to mean one or more of the material that is claimed or described.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Layered Fibrous Structure

Figure 2:
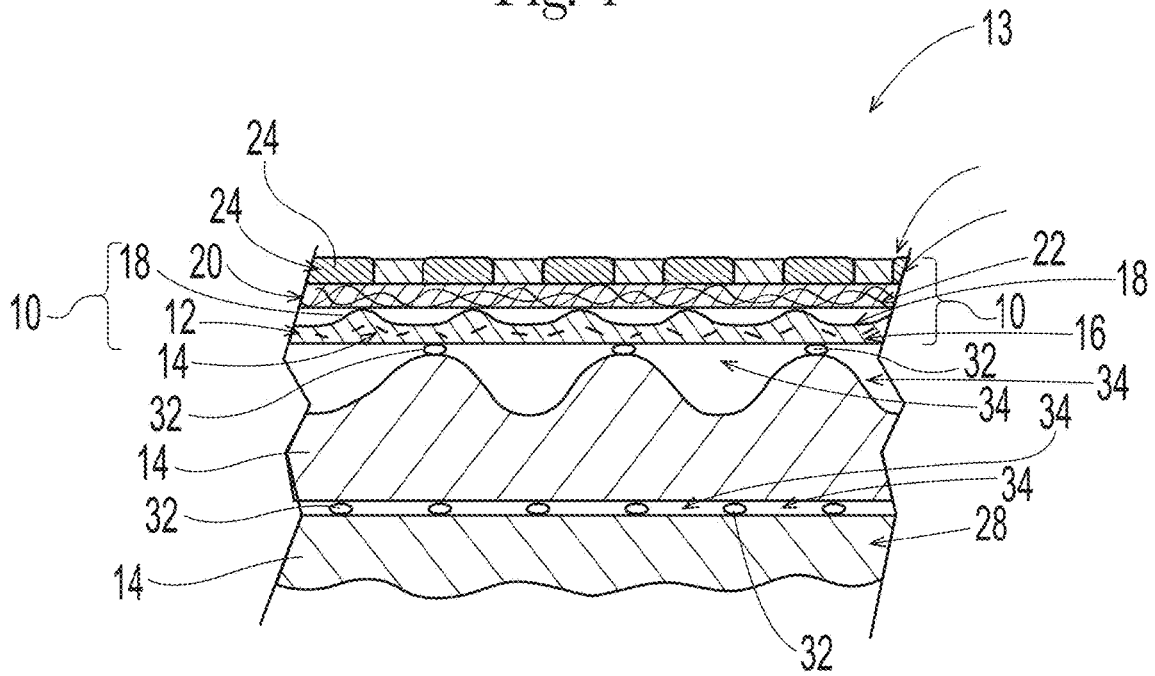
FIG. 2 is a cross-section representation of another example of a multi-ply fibrous structure comprising a layered fibrous structure according to the present invention.

As shown in FIGS. 1 and 2, a layered fibrous structure 10 of the present invention, which may be a standalone fibrous structure (not shown) and/or a component, for example a ply, of a multi-ply fibrous structure, for example a two-ply fibrous structure 11 as shown in FIG. 1 and/or a three or more-ply fibrous structure 13 as shown in FIG. 2, comprises a first layer 12 comprising a plurality of fibrous elements 14, for example naturally-occurring fibrous elements and/or non-naturally-occurring fibrous elements, for example a plurality of fibers 16, such as pulp fibers, for example wood pulp fibers and/or non-wood pulp fibers, and/or a plurality of filaments (not shown). The plurality of fibrous elements 14 of the first layer 12 may exhibit a length of less than 5.08 cm and/or less than 3.81 cm and/or less than 3 cm and/or less than 2.54 cm and/or less than 1 cm and/or less than 8 mm and/or less than 5 mm. The plurality of fibrous elements 14 may be homogeneous and/or in the form of two or more layers of fibrous elements 14. The first layer 12 may be in the form of a first layer material, such as a fibrous structure, for example a wet laid fibrous structure, such as a structured fibrous structure, for example a through-air-dried fibrous structure. When the first layer material comprises two or more layers of fibrous elements 14, the fibrous elements 14 of the layers may be different, for example one layer may comprise hardwood pulp fibers, such as eucalyptus fibers and the other layer may comprise softwood pulp fibers, such as NSK fibers. The layers of fibrous elements 14 may be associated with one another to form the first layer material, such as a fibrous structure, for example a wet laid fibrous structure, such as a structured fibrous structure, for example a through-air-dried fibrous structure. The first layer 12, for example the first layer material, comprises a surface 18.

In addition to the first layer 12, the layered fibrous structure 10 further comprises a second layer 20 comprising a plurality of filaments 22 spun directly onto the surface 18 of the first layer 12, wherein the plurality of filaments 22 are present on the surface 18 of the first layer 12 at a basis weight of 2.5 gsm or less. The plurality of filaments 22 form a filament surface 23 opposite the surface 18 of the first layer 12. The filament surface 23 formed by the plurality of filaments 22 is in the form of an even and/or substantially even and/or flat and/or substantially flat and/or monoplanar and/or substantially monoplanar surface on the surface 18 of the first layer 12.

The second layer 20 of the layered fibrous structure 10 comprises a plurality of filaments 22, for example spun filaments and/or non-naturally occurring filaments, for example hydroxyl polymer filaments. The plurality of filaments 22 of the second layer 20 may exhibit a length of 5.08 cm or greater and/or 7.62 cm or greater and/or 10.16 cm or greater and/or 15.24 cm or greater. The plurality of filaments 22 of the second layer 20 forms a filament surface 23 on a surface of the first layer material of the first layer 12.

The plurality of filaments 22 of the second layer 29 may be associated with the first layer material of the first layer 12 by bonding, such as thermal bonds and/or adhesive bond sites. The plurality of filaments 22 of the second layer 20 may be bonded to the first layer material of the first layer 12 at an edge-to-edge bond distance measured between two bond sites of at least 1 mm and/or at least 1.5 mm and/or at least 1.8 mm and/or at least 2 mm and/or at least 2.5 mm and/or at least 2.5 mm and/or at least 3 mm such that the plurality of filaments 22 of the second layer 20 are movable because they are relatively unbonded and form a movable, unbonded filament surface 23, for example a surface that exhibits a bounded mobility, of the layered fibrous structure 10 and/or multi-ply fibrous structures 11, 13 comprising the layered fibrous structure 10.

The plurality of filaments 22 of the second layer 20 may comprise hydroxyl polymer filaments, for example polysaccharide filaments, such as starch and/or starch derivative filaments and/or polyvinyl alcohol filaments, present at a level of 2.5 gsm or less and/or less than 2.5 gsm and/or less than 2.3 gsm and/or less than 2 gsm and/or less than 1.8 gsm and/or less than 1.6 gsm and/or less than 1.5 gsm and/or greater than 0.1 gsm and/or greater than 0.5 gsm and/or greater than 0.7 gsm and/or greater than 1 gsm.

The plurality of filaments 22 of the second layer 20 may comprise a crosslinked polymer, for example crosslinked starch and/or starch derivative and/or crosslinked polyvinyl alcohol, crosslinked by a crosslinking agent, for example an internal crosslinking agent, such as dihydroxyethyleneurea. In one example, the plurality of filaments 22 of the second layer 20 do not comprise a crosslinking agent, for example an internal crosslinking agent. The crosslinking agent, for example an internal crosslinking agent, when present, in the plurality of filaments 22 of the second layer 20 may be different from any crosslinking agent, for example an external crosslinking agent, for example a crosslinking agent that provides temporary wet strength, for example polyamide-epichlorohydrin-based chemistries, or permanent wet strength, present in the first layer material of the first layer 12, for example a fibrous structure, such as a wet laid fibrous structure.

The plurality of filaments 22 of the second layer 20 may comprise a hydroxyl polymer, for example a non-polysaccharide, such as polyvinyl alcohol and/or a polymer that exhibits a solubility parameter greater than 16.0 $MPa^{1/2}$ and/or greater than 17.0 $MPa^{1/2}$ and/or greater than 18.0 $MPa^{1/2}$ and/or greater than 18.8 $MPa^{1/2}$ and/or greater than 19.0 $MPa^{1/2}$ and/or greater than 20.0 $MPa^{1/2}$ and less than 25.6 $MPa^{1/2}$ and/or less than 25.0 $MPa^{1/2}$ and/or less than 24.0 $MPa^{1/2}$ and/or less than 23.0 $MPa^{1/2}$.

Figure 5:
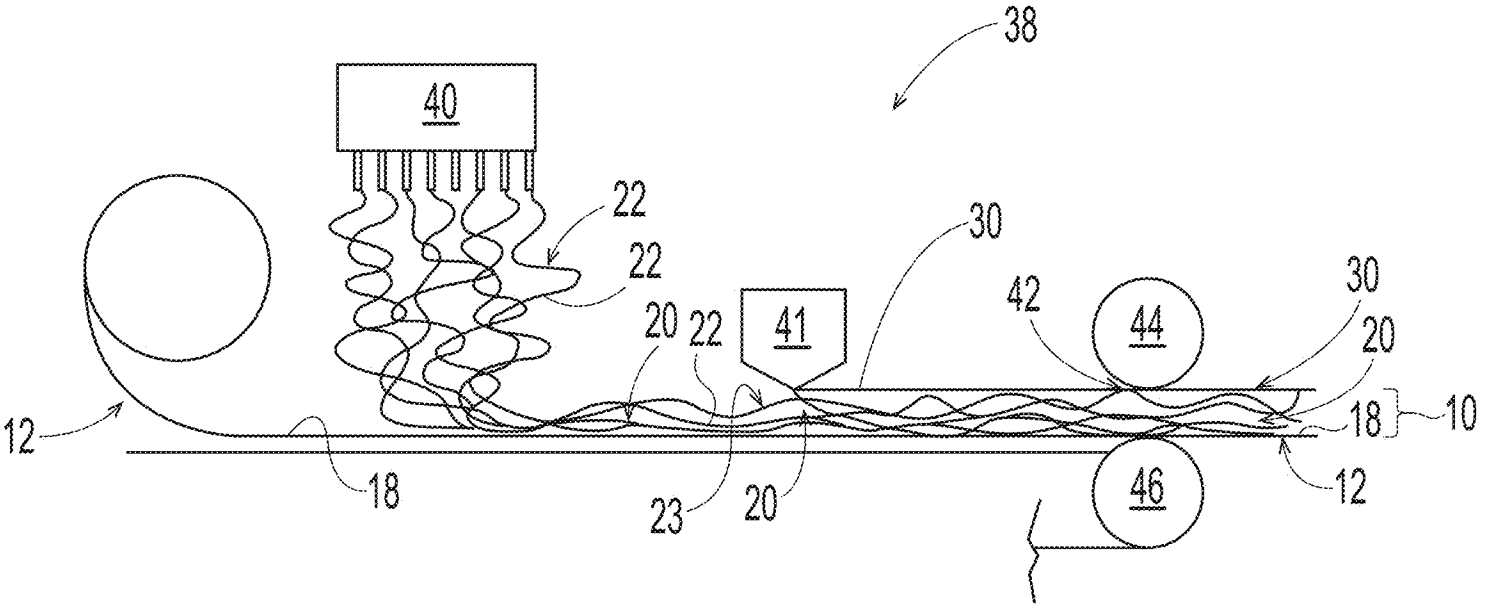
FIG. 5 is a schematic representation of a method for making a layered fibrous structure according to the present invention.

The layered fibrous structure 10 may be made by the fibrous structure making process 38 shown in FIG. 5 by providing a first layer 12, for example a first layer material, comprising a plurality of fibrous elements 14, for example fibers and/or filaments, and spinning a plurality of filaments 22 from one or more filament sources 40 (in this example one), such as a die, for example a meltblow die, such as a multi-row capillary die, directly onto a surface 18 of the first layer 12 to form a second layer 20. In one example, the plurality of filaments 22 are inter-entangled filaments that form a filament surface 23. A surface softening composition 24 is applied to the filament surface 23 of the second layer 20 by a surface softening composition source 41, for example a slot extruder and/or a sprayer and/or a roll, non-spray applications, such as via extrusion dies, for example slot extrusion dies, contact or non-contact, to form the a layered fibrous structure 10. The surface softening composition 24 forms at least a portion of an exterior surface 30, for example a consumer-contacting surface, of the layered fibrous structure 10. The layered fibrous structure making process 38 may further comprise the step of associating the plurality of filaments 22 of the second layer 20 to the first layer 12, for example the first layer material, such as by bonding, for example creating thermal bonds by passing the plurality of filaments 22 of the second layer 20 riding on the first layer 12 through a nip 42 formed by a patterned thermal bond roll 44 and a flat roll 46. The fibrous structure making process 38 may optionally comprise the step of winding the layered fibrous structure ply (first fibrous structure ply 12) into a roll, such as a parent roll for unwinding in a converting operation to cut the roll into consumer-useable sized toilet tissue rolls and/or emboss the fibrous structure and/or perforate the fibrous structure into consumer-useable sized sheets of toilet tissue. In addition, the roll of fibrous structure may be combined with another fibrous structure ply, the same or different as the roll of fibrous structure to make a multi-ply toilet tissue according to the present invention, an example of which is shown in FIGS. 1 and 2.

The layered fibrous structure 10 of the present invention and/or the first layer material of the first layer 12 may be embossed and/or tufted that creates a three-dimensional surface pattern that provides aesthetics and/or improved cleaning properties. In one example, the emboss area may be greater than 10% and/or greater than 12% and/or greater than 15% and/or greater than 20% of the surface area of at least one surface of the layered fibrous structure 10 and/or first layer material of the first layer 12.

Figure 3:
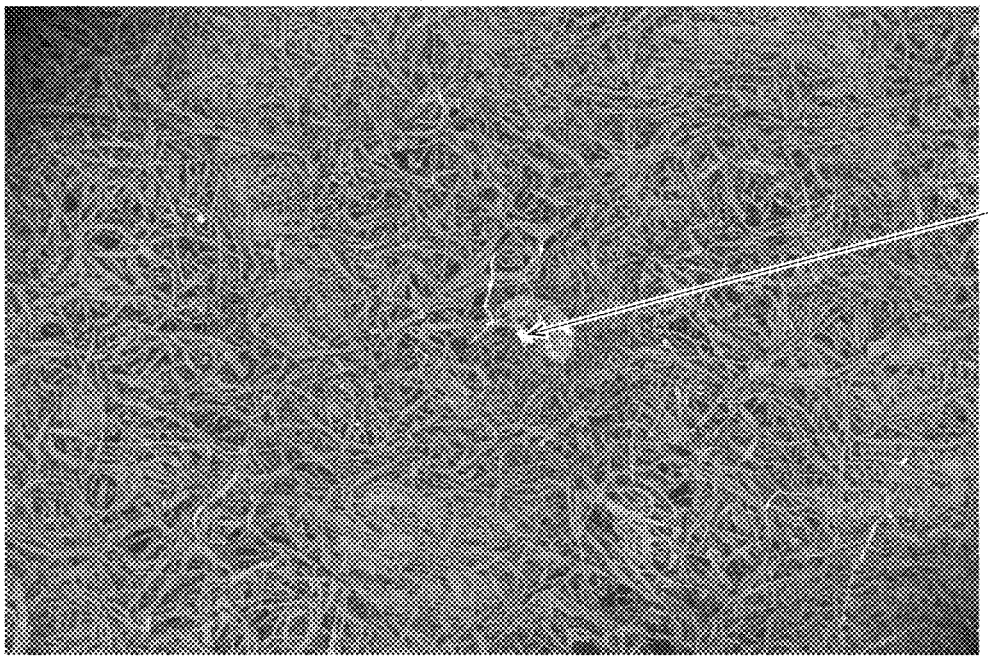
Fig. 3 PRIOR ART
FIG. 3 is a SEM image of a prior art fibrous structure comprising a surface softening composition.
Figure 4:
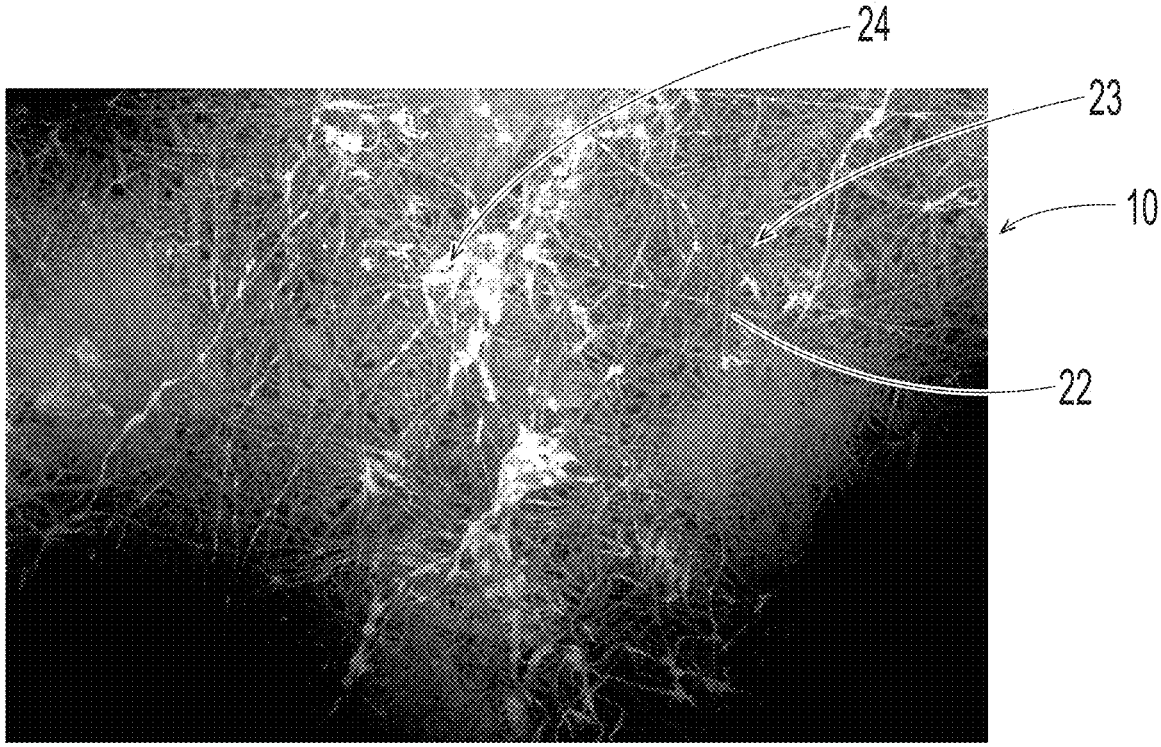
FIG. 4 is a SEM image of a layered fibrous structure according to the present invention.

In addition to the first layer 12 and second layer 20, the layered fibrous structure 10 further comprises a surface softening composition 24. The surface softening composition 24 is present on at least a portion of the filament surface 23 formed by the plurality of filaments 22 of the second layer 20. In one example, the surface softening composition 24 covers greater than 50% and/or greater than 70% and/or greater than 80% and/or greater than 90% and/or greater than 95% and/or about 100% of the surface area of the filament surface 23 at least at the time of application of the surface softening composition 24 onto the filament surface 23 (a portion of more of the surface softening composition 24 may migrate into the second layer 20). In comparison, as shown in Prior Art FIG. 3, a surface softening composition 24 covers less (in one example less than 50% and/or less than 40% and/or less than 30% and/or less than 20% and/or less than 10% and/or less than 8% and/or less than 5%) of the surface area of the consumer-contacting surface of a known wet laid fibrous structure, for example a structured wet laid fibrous structure, such as a through-air dried wet laid fibrous structure whereas as shown in FIG. 4, a surface softening composition 24 covers more than is shown in Prior Art FIG. 3. In one example, the surface softening composition 24 covers greater than 50% and/or greater than 70% and/or greater than 80% and/or greater than 90% and/or greater than 95% and/or about 100% of the surface area of the filament surface 23 formed from a plurality of filaments 22 at least at the time of application of the surface softening composition 24 onto the filament surface 23 (a portion of more of the surface softening composition 24 may migrate into the second layer 20).

In one example, the layered fibrous structure 10 and/or multi-ply fibrous structures 11, 13 comprising the layered fibrous structure 10 of the present invention may exhibit a caliper of greater than 20.0 mils and/or at least about 22.0 mils and/or at least about 24.0 mils and/or at least about 26.0 mils and/or at least about 27.0 mils as measured according to the Caliper Test Method. In one example, the layered fibrous structure 10 and/or multi-ply fibrous structures 11, 13 comprising the layered fibrous structure 10 of the present invention may exhibit a caliper of from about 27.0 mils to about 32.0 mils and/or from about 27.0 mils to about 30.0 mils as measured according to the Caliper Test Method.

In one example, the layered fibrous structure 10 and/or multi-ply fibrous structures 11, 13 comprising the layered fibrous structure 10 of the present invention may exhibit a CRT Capacity of greater than 15 g/g and/or at least about 17 g/g and/or at least about 19 g/g and/or at least about 20 g/g as measured according to the CRT Test Method. In one example, the layered fibrous structure 10 and/or multi-ply fibrous structures 11, 13 comprising the layered fibrous structure 10 of the present invention may exhibit a CRT Capacity of from about 20 g/g to about 28 g/g and/or of from about 20 g/g to about 25 g/g as measured according to the CRT Test Method.

In one example, the layered fibrous structure 10 and/or multi-ply fibrous structures 11, 13 comprising the layered fibrous structure 10 of the present invention may exhibit exhibits a Plate Stiffness of less than about 10 N*mm and/or less than about 8 N*mm and/or less than about 7.70 N*m and/or less than about 6 N*mm as measured according to the Plate Stiffness Test Method. In one example, the layered fibrous structure 10 and/or multi-ply fibrous structures 11, 13 comprising the layered fibrous structure 10 may exhibit a Plate Stiffness of from about 1 N*m to less than 8 N*m and/or from about 4 to about 6 N*mm and/or from about 5 to about 6 N*mm as measured according to the Plate Stiffness Test Method.

In one example, the layered fibrous structure 10 and/or multi-ply fibrous structures 11, 13 comprising the layered fibrous structure 10 of the present invention may exhibit a CRT Rate of less than about 1.0 and/or less than about 0.7 and/or less than about 0.5 less than about 0.3 g/sec as measured according to the CRT Test Method.

In one example, the layered fibrous structure 10 and/or multi-ply fibrous structures 11, 13 comprising the layered fibrous structure 10 of the present invention may exhibit a Basis Weight of at least about 20 gsm and/or at least about 25 gsm and/or at least about 30 gsm and/or at least about 35 gsm and/or at least about 40 gsm and/or at least about 45 gsm and/or at least about 50 gsm and/or at least about 55 gsm as measured according to the Basis Weight Test Method. In one example, the layered fibrous structure 10 and/or multi-ply fibrous structures 11, 13 comprising the layered fibrous structure 10 may exhibit a Basis Weight of at least about 10 gsm to about 120 gsm and/or at least about 20 gsm to about 80 gsm as measured according to the Basis Weight Test Method. The layered fibrous structure 10 and/or multi-ply fibrous structures comprising the layered fibrous structure 10 may exhibit a Basis Weight of at least about 10 gsm to about 60 gsm and/or at least 10 gsm to about 55 gsm and/or at least about 20 gsm to about 55 gsm and/or at least about 25 gsm to about 55 gsm as measured according to the Basis Weight Test Method.

In one example, the layered fibrous structure 10 and/or multi-ply fibrous structures 11, 13 comprising the layered fibrous structure 10 of the present invention is flushable and/or dispersible and/or suitable for municipal wastewater and sewer systems and/or septic systems.

In one example, the layered fibrous structure 10 and/or multi-ply fibrous structures 11, 13 comprising the layered fibrous structure 10 of the present invention exhibits a Total Wet Decay of greater than 30% and/or greater than 40% and/or greater than 50% and/or greater than 60% as measured according to the Wet Decay Test Method.

In one example, the layered fibrous structure 10 and/or multi-ply fibrous structures 11, 13 comprising the layered fibrous structure 10 of the present invention exhibits an Initial Total Wet Tensile of greater than 30 g/in and/or greater than 40 g/in and/or greater than 50 g/in and/or greater than 60 g/in as measured according to the Wet Tensile Test Method.

In one example, the layered fibrous structure 10 and/or multi-ply fibrous structures 11, 13 comprising the layered fibrous structure 10 of the present invention exhibits a Total Dry Tensile of greater than 150 g/in and/or greater than about 200 g/in and/or greater than about 250 g/in and/or greater than about 350 g/in greater than about 500 g/in as measured according to the Dry Tensile Test Method. In one example, the layered fibrous structure 10 and/or multi-ply fibrous structures 11, 13 comprising the layered fibrous structure 10 exhibits a Total Dry Tensile of from about 150 g/in to about 1000 g/in and/or from about 200 g/in to about 1000 g/in and/or from about 250 g/in to about 850 g/in and/or from about 350 g/in to about 850 g/in and/or from about 500 g/in to about 850 g/in as measured according to the Dry Tensile Test Method.

In one example, the layered fibrous structure 10 and/or multi-ply fibrous structures 11, 13 comprising the layered fibrous structure 10 of the present invention exhibits a Flexural Rigidity of less than about 700 mg-cm and/or less than about 500 mg-cm and/or less than about 450 mg-cm and/or less than about 400 mg-cm as measured according to the Flexural Rigidity Test Method. In one example, the layered fibrous structure 10 and/or multi-ply fibrous structures 11, 13 comprising the layered fibrous structure 10 exhibits a Flexural Rigidity of from about 500 mg-cm to about 100 mg-cm and/or from about 450 mg-cm to about 200 mg-cm and/or from about 400 mg-cm to about 300 mg-cm as measured according to the Flexural Rigidity Test Method.

The layered fibrous structure 10 and/or multi-ply fibrous structures 11, 13 comprising the layered fibrous structure 10 of the present invention may exhibit any combination of the properties described herein.

The layered fibrous structure 10 and/or multi-ply fibrous structures 11, 13 comprising the layered fibrous structure 10 of the present invention may comprise at least one fibrous structure comprising a structured fibrous structure, including structured fibrous structures formed on NTT and/or ATMOS papermaking lines and/or through-air-dried fibrous structures, such as a creped through-air-dried fibrous structures and/or uncreped through-air-dried fibrous structures.

The layered fibrous structure 10 and/or multi-ply fibrous structures 11, 13 comprising the layered fibrous structure 10 of the present invention may comprise at least one belt creped fibrous structure.

The layered fibrous structure 10 and/or multi-ply fibrous structures 11, 13 comprising the layered fibrous structure 10 of the present invention may comprise at least one fabric creped fibrous structure.

The layered fibrous structure 10 and/or multi-ply fibrous structures 11, 13 comprising the layered fibrous structure 10 of the present invention may comprise at least one conventional wet-pressed fibrous structure.

The layered fibrous structure 10 and/or multi-ply fibrous structures 11, 13 comprising the layered fibrous structure 10 of the present invention may comprise at least one embossed fibrous structure.

The layered fibrous structure 10 and/or multi-ply fibrous structures 11, 13 comprising the layered fibrous structure 10 of the present invention may comprise at least one fibrous element, for example a fiber, such as a pulp fiber, which may be a wood pulp fiber.

The layered fibrous structure 10 and/or multi-ply fibrous structures 11, 13 comprising the layered fibrous structure 10 of the present invention may comprise at least one fibrous element, for example a filament, such as a filament comprising a hydroxyl polymer, which may be a polysaccharide, such as a polysaccharide is selected from the group consisting of: starch, starch derivatives, cellulose derivatives, hemicellulose, hemicellulose derivatives, and mixtures thereof, more specifically starch. In one example, the hydroxyl polymer may comprise polyvinyl alcohol.

As shown in FIGS. 1 and 2, multi-ply fibrous structures 11, 13 that comprise the layered fibrous structure 10 of the present invention comprise one or more fibrous structures 26, 28. The one or more fibrous structure 26, 28 may comprise a plurality of fibrous elements 14, for example fibers and/or filaments. The surface softening composition 24 forms at least a portion of an exterior surface 30 and/or the entire exterior surface 30, for example a consumer-contacting surface of the layered fibrous structure 10 and/or of the multi-ply fibrous structures 11, 13.

In one example, the exterior surface 30 at least partially forms a consumer-contacting surface that comes into contact with a consumer during use, such as during wiping, of the layered fibrous structure 10 and/or multi-ply fibrous structures 11, 13 of the present invention. The exterior surface 30 of the layered fibrous structure 10 may comprise and/or be defined by at least a portion of the filament surface 23 of the second layer 20.

At least one and/or at least two of the fibrous structures 26, 28 of the multi-ply fibrous structures 11, 13 of the present invention may be the same and/or different to one another for example in texture, caliper, basis weight, fibrous element (fibers and/or filaments) composition.

At least two or more and/or at least three of more of the layered fibrous structure 10 and one or more of the fibrous structures 26, 28 may be laminated and/or bonded together, for example adhesively bonded together, such as by a plybond glue 32, for example a hot melt glue and/or a cold glue. At least two or more and/or at least three of more of the layered fibrous structure 10 an one or more of the fibrous structures 26, 28 may be bonded together, for example adhesively bonded together in a pattern, for example a non-random repeating pattern and/or a stripe. In one example, the layered fibrous structure 10 and fibrous structure 26 may be bonded together, for example adhesively bonded together, in a first pattern and the fibrous structure 26 and fibrous structure 28 may be bonded together, for example adhesively bonded together, in a second pattern, which may be the same or different from the first pattern.

In one example, the multi-ply fibrous structures 11, 13 (two-ply (FIG. 1) and three-ply (FIG. 2)) may comprise void space, for example interply void space 34. An interply void space 34 may be formed by a layered fibrous structure 10 and/or one or more fibrous structures 26, 28 bridging a texture, such as depressions, channels, or protrusions, such as imparted to a surface of an adjacent fibrous structure 26, 28 by a patterned molding member, for example a patterned resin molding member and/or a through-air-drying fabric, such as a coarse through-air-drying fabric, for example as is used in the UCTAD process, and/or an embossing operation and/or a creping operation, such as a belt creping operation and/or a fabric creping operation and/or creping off a drying cylinder, such as a Yankee. The interply void spaces 34 of the multi-ply fibrous structures 11, 13 may be seen using different imaging tools, such as μCT.

In addition, the layered fibrous structure 10 may comprise void space, for example intraply void space 36. An intraply void space 36 may be formed by the second layer 20 bridging a texture, such as depressions, channels, or protrusions, such as imparted to a surface of the first layer material of the first layer 12, for example a fibrous structure, by a patterned molding member, for example a patterned resin molding member and/or a through-air-drying fabric, such as a coarse through-air-drying fabric, for example as is used in the UCTAD process, and/or an embossing operation and/or a creping operation, such as a belt creping operation and/or a fabric creping operation and/or creping off a drying cylinder, such as a Yankee. The intraply void spaces 36 of the layered fibrous structure 10 may be seen using different imaging tools, such as μCT.

The layered fibrous structure may be a wet fibrous structure, for example a layered fibrous structure comprising a liquid composition.

In addition, the layered fibrous structure of the present invention and/or fibrous structure plies of the layered fibrous structure may be non-lotioned and/or may not contain a post-applied surface chemistry. The layered fibrous structure of the present invention and/or fibrous structure plies of the layered fibrous structure may be creped or uncreped. The layered fibrous structure of the present invention and/or fibrous structure plies of the layered fibrous structure may be uncreped fibrous structure plies. An exterior surface of the layered fibrous structure of the present invention and/or fibrous structure plies of the layered fibrous structure may not be creped (uncreped and/or non-undulating and/or not creped off a surface, such as a Yankee), however the any of the web materials making up the fibrous structure plies may be creped (undulating and/or creped off a surface, such as a Yankee).

In addition to the layered fibrous structure 10 and/or multi-ply fibrous structures of the present invention exhibiting improved surface properties as described herein, such layered fibrous structures also may exhibit improved cleaning properties, for example bowel movement cleaning properties, compared to known fibrous structures, for example known fibrous structures comprising hydroxyl polymer filaments and known fibrous structures, such as wet-laid and/or air-laid, comprising cellulose fibers, for example pulp fibers. Without wishing to be bound by theory, it is believed that the layered fibrous structures of the present invention exhibit improved skin benefit and/or glide on skin properties and/or cleaning properties due to the hydroxyl polymer fibrous elements of the present invention exhibiting greater absorbency, without a gooey feel, than pulp fibers, and therefore facilitates better, in reality and/or perception, absorption of bowel movement and/or urine more completely and/or faster than known fibrous structures.

The layered fibrous structure 10 and/or multi-ply fibrous structures of the present invention may be embossed and/or tufted that creates a three-dimensional surface pattern that provides aesthetics and/or improved cleaning properties. The level of improved cleaning properties relates to the % contact area under a load, such as a user's force applied to the fibrous structure during wiping, and/or % volume/area under a load, such as a user's force applied to the fibrous structure during wiping, created by the three-dimensional surface pattern on the surface of the fibrous structure. In one example, the emboss area may be greater than 10% and/or greater than 12% and/or greater than 15% and/or greater than 20% of the surface area of at least one surface of the fibrous structure.

In one example, the layered fibrous structures of the present invention exhibit a Peak Load value of greater than about 25 g and/or greater than about 30 g and/or greater than about 35 g and/or greater than 40 g to less than about 120 g and/or to less than about 100 g and/or to less than about 80 g as measured according to the Glide Test Method—4 Inch Sample described herein. It has unexpectedly been found that fibrous structures, for example layered fibrous structures, that exhibit a Peak Load value of less than 25 g are considered too slippery/slick and provide poor bowel movement cleaning during use. Further, it has unexpectedly been found that fibrous structures, for example layered fibrous structures, that exhibit a Peak Load value of greater than 120 g result in roll dispensing negatives, for example where the consumer cannot find the tail end of the roll for easy/hassle free dispensing during use.

First Layer (12)

The first layer 12 comprises a first layer material, which may comprise a plurality of fibrous elements, for example a plurality of fibers, such as greater than 80% and/or greater than 90% and/or greater than 95% and/or greater than 98% and/or greater than 99% and/or 100% by weight of the first layer material of fibers.

The first layer material may comprise a plurality of naturally-occurring fibers, for example pulp fibers, such as wood pulp fibers (hardwood and/or softwood pulp fibers). In another example, the first layer material comprises a plurality of non-naturally occurring fibers (synthetic fibers), for example staple fibers, such as rayon, lyocell, polyester fibers, polycaprolactone fibers, polylactic acid fibers, polyhydroxyalkanoate fibers, and mixtures thereof. In another example, the first layer material comprises a mixture of naturally-occurring fibers, for example pulp fibers, such as wood pulp fibers (hardwood and/or softwood pulp fibers) and a plurality of non-naturally occurring fibers (synthetic fibers), for example staple fibers, such as rayon, lyocell, polyester fibers, polycaprolactone fibers, polylactic acid fibers, polyhydroxyalkanoate fibers, and mixtures thereof.

The first layer material may comprise a wet laid fibrous structure, such as a through-air-dried fibrous structure, for example an uncreped, through-air-dried fibrous structure ply and/or a creped, through-air-dried fibrous structure ply.

The first layer material, for example a wet laid fibrous structure ply may exhibit substantially uniform density.

The first layer material, for example a wet laid fibrous structure ply may exhibit differential density.

The first layer material, for example a wet laid fibrous structure ply may comprise a surface pattern.

The first layer material, for example a wet laid fibrous structure ply may comprise a conventional wet-pressed fibrous structure ply. The wet laid fibrous structure ply may comprise a fabric-creped fibrous structure ply. The wet laid fibrous structure ply may comprise a belt-creped fibrous structure ply.

The first layer material may comprise an air laid fibrous structure ply.

The first layer materials of the present invention may comprise a surface softening agent or be void of a surface softening agent, such as silicones, quaternary ammonium compounds, lotions, and mixtures thereof. The toilet tissue and/or first layer material of the toilet tissue may comprise a non-lotioned first layer material.

The first layer materials of the present invention may comprise trichome fibers or may be void of trichome fibers.

Patterned Molding Members

The first layer material of the present invention may be formed on patterned molding members, for example coarse through-air-drying fabrics, such as UCTAD fabrics, patterned resin-containing molding members, patterned rollers, patterned belt-creping molding members, patterned fabric-creping molding members, other patterned papermaking clothing, that result in the first layer materials, for example structured materials, such as structure fibrous structures of the present invention. The pattern molding member may comprise a non-random repeating pattern. The pattern molding member may comprise a resinous pattern.

The first layer material may comprise a textured surface. The first layer material may comprise a surface comprising a three-dimensional (3D) pattern, for example a 3D pattern imparted to the first layer material by a patterned molding member. Non-limiting examples of suitable patterned molding members include patterned felts, patterned forming wires, patterned rolls, patterned fabrics, and patterned belts utilized in conventional wet-pressed papermaking processes, air-laid papermaking processes, and/or wet-laid papermaking processes that produce 3D patterned fibrous structures suitable for use as the first layer material. Other non-limiting examples of such patterned molding members include through-air-drying fabrics and through-air-drying belts utilized in through-air-drying papermaking processes that produce through-air-dried fibrous structures, for example 3D patterned through-air dried fibrous structures, and/or through-air-dried toilet tissue comprising the first layer material.

The first layer material 12 may comprise a 3D patterned first layer material having a surface comprising a 3D pattern.

The first layer material may be made by any suitable method, such as wet-laid, air laid, coform, hydroentangling, carding, meltblowing, spunbonding, and mixtures thereof. In one example, the method for making the first layer material of the present invention comprises the step of depositing a plurality of fibrous elements, for example a plurality of fibers onto a collection device, such as a 3D patterned molding member such that a first layer material is formed.

A "reinforcing element" may be a desirable (but not necessary) element in some examples of the molding member, serving primarily to provide or facilitate integrity, stability, and durability of the molding member comprising, for example, a resinous material. The reinforcing element can be fluid-permeable or partially fluid-permeable, may have a variety of embodiments and weave patterns, and may comprise a variety of materials, such as, for example, a plurality of interwoven yarns (including Jacquard-type and the like woven patterns), a felt, a plastic, other suitable synthetic material, or any combination thereof.

Figure 6:
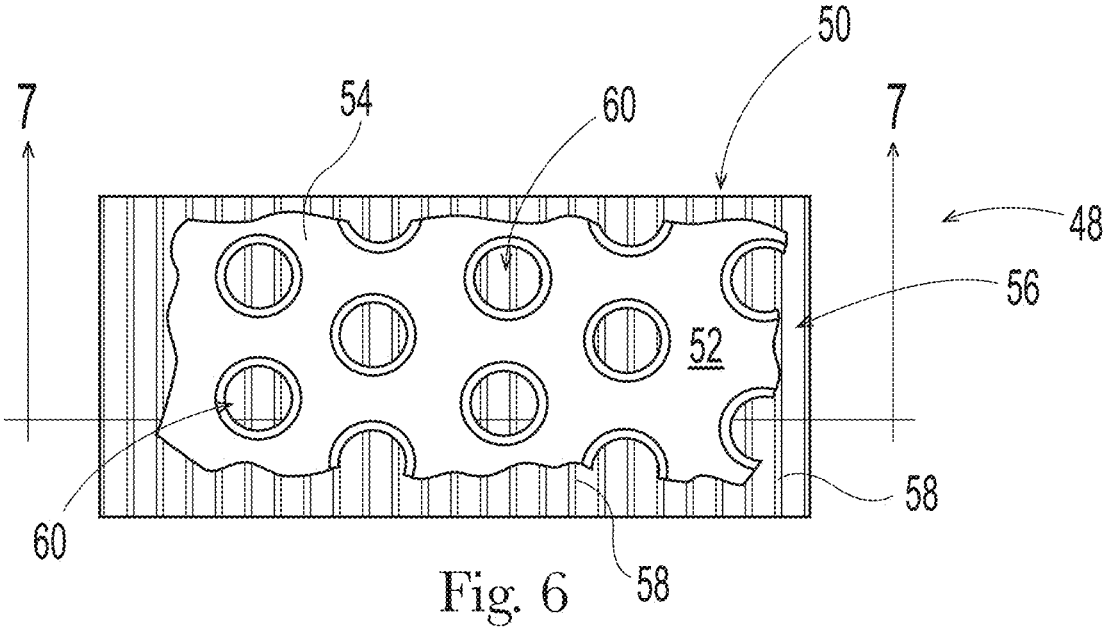
FIG. 6 is a top plan view of a patterned molding member according to the present invention.
Figure 7:
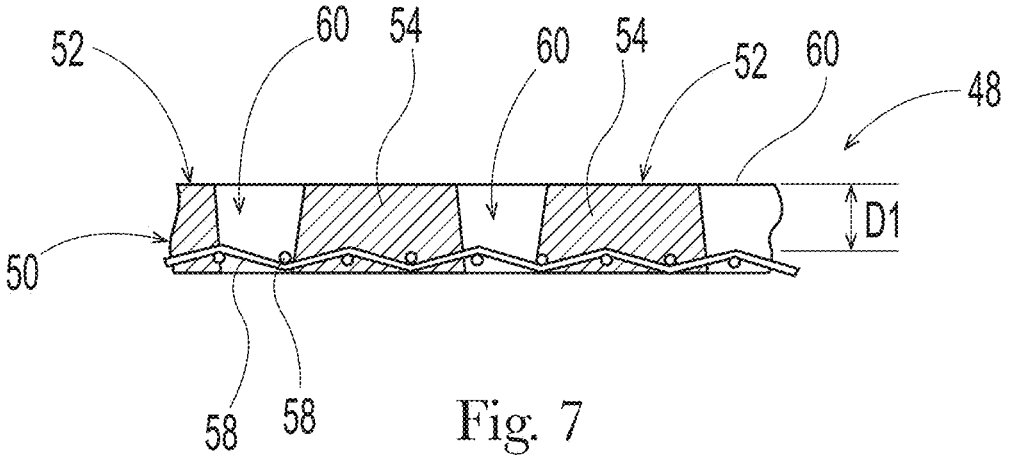
FIG. 7 is a cross-section view of the patterned molding member of FIG. 6 taken along line 7-7.

As shown in FIGS. 6 and 7, a non-limiting example of a patterned molding member 48, in this case a through-air-drying belt, suitable for use in the present invention comprises a continuous network knuckle 52 formed by a resin 54 arranged in a non-random, repeating pattern supported on a support fabric 56 comprising filaments 58. The continuous network knuckle 52 of resin 54 comprises deflection conduits 60 into which portions of a first layer material being made on the patterned molding member 48 deflect thus imparting the pattern of the patterned molding member 48 to the first layer material, for example wet laid fibrous structure, resulting in a structured first layer material and/or structures fibrous structure for use in the layered fibrous structure of the present invention. The deflected portions of the first layer material result in pillows, for example lower density regions compared to other parts of the first layer material, within the structured first layer material and/or structured fibrous structure. The continuous network knuckle 52, in this case, and other forms and/or shapes, discrete and/or continuous knuckles impart knuckles, for example higher density regions compared to other parts of the first layer material, such as pillows.

As shown in FIG. 7, the resin 54 may be present on the support fabric 56 at a height DI of greater than 5.0 mils and/or greater than 7.0 mils and/or greater than 8.0 mils and/or greater than 10.0 mils and/or greater than 12.0 mils and/or greater than 13.0 mils and/or greater than 15.0 mils and/or greater than 17.0 mils and/or greater than 20.0 mils in order to define deflection conduits 60 that impart one or more pillows within a structured first layer material that exhibit similar heights.

Non-Limiting Examples of Making First Layer Material

The first layer materials of the present invention may be made by any suitable papermaking process, such as conventional wet press papermaking process, through-air-dried papermaking process, belt-creped papermaking process, fabric-creped papermaking process, creped papermaking process, uncreped papermaking process, coform process, and air-laid process, so long as the first layer material comprises a plurality of fibers. In one example, the first layer material is made on a molding member of the present invention is used to make the first layer material of the present invention. The method may be a first layer material making process that uses a cylindrical dryer such as a Yankee (a Yankee-process) or it may be a Yankeeless process as is used to make substantially uniform density and/or uncreped first layer materials (fibrous structures). Alternatively, the first layer materials may be made by an air-laid process and/or meltblown and/or spunbond processes and any combinations thereof so long as the first layer materials of the present invention are made thereby.

Figure 8:
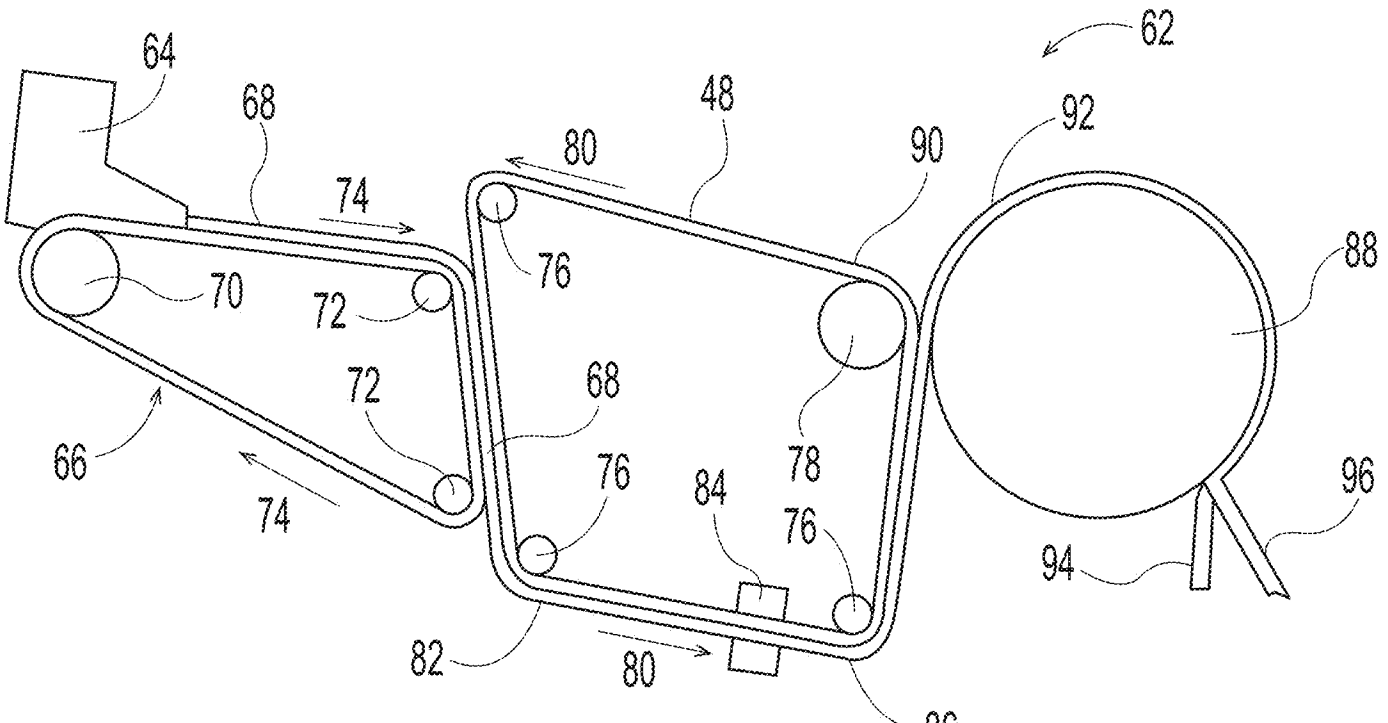
FIG. 8 is a schematic representation of a method for making a first layer material according to the present invention.

As shown in FIG. 8, one example of a process and equipment, represented as 62 for making a first layer material, for example a structured first layer material and/or structure fibrous structure ply according to the present invention comprises supplying an aqueous dispersion of fibers (a fibrous furnish or fiber slurry) to a headbox 64 which can be of any convenient design. From headbox 64 the aqueous dispersion of fibers is delivered to a first foraminous member 66 which is typically a Fourdrinier wire, to produce an embryonic fibrous structure 68.

The first foraminous member 66 may be supported by a breast roll 70 and a plurality of return rolls 72 of which only two are shown. The first foraminous member 66 can be propelled in the direction indicated by directional arrow 74 by a drive means, not shown. Optional auxiliary units and/or devices commonly associated fibrous structure making machines and with the first foraminous member 66, but not shown, include forming boards, hydrofoils, vacuum boxes, tension rolls, support rolls, wire cleaning showers, and the like.

After the aqueous dispersion of fibers is deposited onto the first foraminous member 66, embryonic fibrous structure (embryonic web material) 68 is formed, typically by the removal of a portion of the aqueous dispersing medium by techniques well known to those skilled in the art. Vacuum boxes, forming boards, hydrofoils, and the like are useful in effecting water removal. The embryonic fibrous structure 68 may travel with the first foraminous member 66 about return roll 72 and is brought into contact with a patterned molding member 48, such as a 3D patterned through-air-drying belt as shown in FIGS. 6 and 7. While in contact with the patterned molding member 48, the embryonic fibrous structure 68 will be deflected, rearranged, and/or further dewatered.

The patterned molding member 48 may be in the form of an endless belt. In this simplified representation, the patterned molding member 48 passes around and about patterned molding member return rolls 76 and impression nip roll 78 and may travel in the direction indicated by directional arrow 80. Associated with patterned molding member 48, but not shown, may be various support rolls, other return rolls, cleaning means, drive means, and the like well-known to those skilled in the art that may be commonly used in fibrous structure making machines.

After the embryonic fibrous structure 68 has been associated with the patterned molding member 48, fibers within the embryonic fibrous structure 68 are deflected into pillows and/or pillow network (deflection conduits 60 shown in FIGS. 6 and 7) present in the patterned molding member 48. In one example of this process step, there is essentially no water removal from the embryonic fibrous structure 68 through the deflection conduits 60 after the embryonic fibrous structure 68 has been associated with the patterned molding member 48 but prior to the deflecting of the fibers (portions of the web material) into the deflection conduits 60. Further water removal from the embryonic fibrous structure 68 can occur during and/or after the time the fibers are being deflected into the deflection conduits 60. Water removal from the embryonic fibrous structure 68 may continue until the consistency of the embryonic fibrous structure 68 associated with patterned molding member 48 is increased to from about 25% to about 35%. Once this consistency of the embryonic fibrous structure 68 is achieved, then the embryonic fibrous structure 68 can be referred to as an intermediate fibrous structure (intermediate web material) 82. During the process of forming the embryonic fibrous structure 68, sufficient water may be removed, such as by a noncompressive process, from the embryonic fibrous structure 68 before it becomes associated with the patterned molding member 48 so that the consistency of the embryonic fibrous structure 68 may be from about 10% to about 30%.

While applicants decline to be bound by any particular theory of operation, it appears that the deflection of the fibers in the embryonic fibrous structure and water removal from the embryonic fibrous structure begin essentially simultaneously. Embodiments can, however, be envisioned wherein deflection and water removal are sequential operations. Under the influence of the applied differential fluid pressure, for example, the fibers may be deflected into the deflection conduit with an attendant rearrangement of the fibers. Water removal may occur with a continued rearrangement of fibers. Deflection of the fibers, and of the embryonic fibrous structure, may cause an apparent increase in surface area of the embryonic fibrous structure. Further, the rearrangement of fibers may appear to cause a rearrangement in the spaces or capillaries existing between and/or among fibers.

It is believed that the rearrangement of the fibers can take one of two modes dependent on a number of factors such as, for example, fiber length. The free ends of longer fibers can be merely bent in the space defined by the deflection conduit while the opposite ends are restrained in the region of the ridges. Shorter fibers, on the other hand, can actually be transported from the region of the ridges into the deflection conduit (The fibers in the deflection conduits will also be rearranged relative to one another). Naturally, it is possible for both modes of rearrangement to occur simultaneously.

As noted, water removal occurs both during and after deflection; this water removal may result in a decrease in fiber mobility in the embryonic fibrous structure. This decrease in fiber mobility may tend to fix and/or freeze the fibers in place after they have been deflected and rearranged. Of course, the drying of the fibrous structure in a later step in the process of this invention serves to more firmly fix and/or freeze the fibers in position.

Any convenient means conventionally known in the papermaking art can be used to dry the intermediate fibrous structure 82. Examples of such suitable drying process include subjecting the intermediate fibrous structure 82 to conventional and/or flow-through dryers and/or Yankee dryers.

In one example of a drying process, the intermediate fibrous structure 82 in association with the patterned molding member 48 passes around the patterned molding member return roll 76 and travels in the direction indicated by directional arrow 80. The intermediate fibrous structure 82 may first pass through an optional predryer 84. This predryer 84 can be a conventional flow-through dryer (hot air dryer) well known to those skilled in the art. Optionally, the predryer 84 can be a so-called capillary dewatering apparatus. In such an apparatus, the intermediate fibrous structure 82 passes over a sector of a cylinder having preferential-capillary-size pores through its cylindrical-shaped porous cover. Optionally, the predryer 84 can be a combination capillary dewatering apparatus and flow-through dryer. The quantity of water removed in the predryer 84 may be controlled so that a predried fibrous structure 86 exiting the predryer 84 has a consistency of from about 30% to about 98%. The predried fibrous structure 86, which may still be associated with patterned molding member 48, may pass around another patterned molding member return roll 76 as it travels to an impression nip roll 78. As the predried fibrous structure 86 passes through the nip formed between impression nip roll 78 and a surface of a Yankee dryer 88, the pattern formed by the top surface 90 of the patterned molding member 48 is impressed into the predried fibrous structure 86 to form a structured fibrous structure (structured first layer material), for example a 3D patterned fibrous structure (3D patterned first layer material) 92. The structured fibrous structure 92 can then be adhered to the surface of the Yankee dryer 88 where it can be dried to a consistency of at least about 95%.

The structured fibrous structure 92 can then be foreshortened by creping the structured fibrous structure 92 with a creping blade 94 to remove the structured fibrous structure 92 from the surface of the Yankee dryer 88 resulting in the production of a structured creped fibrous structure (structured creped first layer material) 96 in accordance with the present invention. As used herein, foreshortening refers to the reduction in length of a dry (having a consistency of at least about 90% and/or at least about 95%) fibrous structure which occurs when energy is applied to the dry fibrous structure in such a way that the length of the fibrous structure is reduced and the fibers in the fibrous structure are rearranged with an accompanying disruption of fiber-fiber bonds. Foreshortening can be accomplished in any of several well-known ways. One common method of foreshortening is creping. The structured creped fibrous structure 96 may be used as is as a structure fibrous structure ply in the toilet tissue of the present invention or it may be subjected to post processing steps such as calendaring, tuft generating operations, and/or embossing and/or converting to form a structured fibrous structure ply and then used in the toilet tissue of the present invention.

Second Layer (20)

The second layer comprises a plurality of filaments. The plurality of filaments of the second layer may be produced from a polymer melt composition, for example a hydroxyl polymer melt composition such as an aqueous hydroxyl polymer melt composition, comprising a hydroxyl polymer, such as an uncrosslinked starch for example a dent corn starch, an acid-thinned starch, a waxy starch, and/or a starch derivative such as an ethoxylated starch, a crosslinking system comprising a crosslinking agent, such as an imidazolidinone may be used, but is not necessary, especially if the hydroxyl polymer is polyvinyl alcohol, and water. The hydroxyl polymer may exhibit a weight average molecular weight in the range of 50,000 g/mol to 40,000,000 g/mol as measured according to the Weight Average Molecular Weight Test Method described herein. In one example, the crosslinking agent comprises less than 2% and/or less than 1.8% and/or less than 1.5% and/or less than 1.25% and/or 0% and/or about 0.25% and/or about 0.50% by weight of a base, for example triethanolamine. It has unexpectedly been found that the reducing the level of base in the crosslinking agent used in the polymer melt composition results in more effective crosslinking when present. In one example, the filaments of the present invention comprise greater than 25% and/or greater than 40% and/or greater than 50% and/or greater than 60% and/or greater than 70% to about 95% and/or to about 90% and/or to about 80% by weight of the filament of a hydroxyl polymer, such as starch, which may be in a crosslinked state. In one example, the filament comprises an ethoxylated starch and an acid thinned starch, which may be in their crosslinked states.

The filaments of the second layer may exhibit an average diameter of less than 50 μm and/or less than 25 μm and/or less than 20 μm and/or less than 15 μm and/or less than 10 μm and/or greater than 1 μm and/or greater than 3 μm and/or from about 3-10 μm and/or from about 3-8 μm and/or from about 5-7 μm as measured according to the Average Diameter Test Method described herein. In one example, the filaments of the second layer may exhibit smaller average diameters, for example from about 1 to about 3 μm, and/or less than from about 1 to less than 2 μm, for example when the filaments comprise polyvinyl alcohol filaments.

The filaments may also comprise a crosslinking agent, such as an imidazolidinone, such as dihydroxyethyleneurea (DHEU), which may be in its crosslinked state (crosslinking the hydroxyl polymers present in the filaments) at a level of from about 0.25% and/or from about 0.5% and/or from about 1% and/or from about 2% and/or from about 3% and/or to about 10% and/or to about 7% and/or to about 5.5% and/or to about 4.5% by weight of the filament. In addition to the crosslinking agent, the filament may comprise a crosslinking facilitator that aids the crosslinking agent at a level of from 0% and/or from about 0.3% and/or from about 0.5% and/or to about 2% and/or to about 1.7% and/or to about 1.5% by weight of the filament.

The filaments of the second layer, for example hydroxyl polymer filaments, may comprise a crosslinked hydroxyl polymer, such as a crosslinked starch and/or starch derivative.

The filaments of the second layer may also comprise a surfactant, such as a sulfosuccinate surfactant. A non-limiting example of a suitable sulfosuccinate surfactant comprises Aerosol® AOT (a sodium dioctyl sulfosuccinate) and/or Aerosol® MA-80 (a sodium dihexyl sulfosuccinate), which are commercially available from Cytec. The surfactant, such as a sulfosuccinate surfactant, may be present at a level of from 0% and/or from about 0.1% and/or from about 0.3% to about 2% and/or to about 1.5% and/or to about 1.1% and/or to about 0.7% by weight of the filament.

The filaments of the second layer may also comprise a weak acid, such as malic acid. The malic acid may be present at a level from 0% to 1% and/or from by weight of the filament.

In addition to the crosslinking agent, the filaments may comprise a crosslinking facilitator such as ammonium salts of methanesulfonic acid, ethanesulfonic acid, propanesulfonic acid, isopropylsulfonic acid, butanesulfonic acid, isobutylsulfonic acid, sec-butylsulfonic acids, benzenesulfonic acid, toluenesulfonic acid, xylenesulfonic acid, cumenesulfonic acid, alkylbenzenesulfonic, alkylnaphthalenedisulfonic acids.

The filaments may also comprise a polymer selected from the group consisting of: polyacrylamide and its derivatives; acrylamide-based copolymers, polyacrylic acid, polymethacrylic acid, and their esters; polyethyleneimine; copolymers made from mixtures of monomers of the aforementioned polymers; and mixtures thereof at a level of from 0% and/or from about 0.01% and/or from about 0.05% and/or to about 0.5% and/or to about 0.3% and/or to about 0.2% by weight of the filament. Such polymers may exhibit a weight average molecular weight of greater than 500,000 g/mol. In one example, the filament comprises polyacrylamide.

The filaments may also comprise various other ingredients such as propylene glycol, sorbitol, glycerin, and mixtures thereof.

One or more hueing agents, such as Violet CT may also be present in the polymer melt composition and/or filaments formed therefrom.

In one example, the filaments, of the present invention comprise a filament-forming polymer, such as a hydroxyl polymer, for example a crosslinked hydroxyl polymer. In one example, the filaments may comprise two or more filament-forming polymers, such as two or more hydroxyl polymers. In another example, the filament may comprise two or more filament-forming polymers, such as two or more hydroxyl polymers, at least one of which is starch and/or a starch derivative. In still another example, the filaments of the present invention may comprise two or more filament-forming polymers at least one of which is a hydroxyl polymer and at least one of which is a non-hydroxyl polymer.

In yet another example, the filaments of the present invention may comprise two or more non-hydroxyl polymers. In one example, at least one of the non-hydroxyl polymers exhibits a weight average molecular weight of greater than 1,400,000 g/mol and/or is present in the filaments at a concentration greater than its entanglement concentration ($C_e$) and/or exhibits a polydispersity of greater than 1.32. In still another example, at least one of the non-hydroxyl polymers comprises an acrylamide-based copolymer.

The filaments of the second layer may be produced from a polymer melt composition. The polymer melt composition, for example an aqueous polymer melt composition such as an aqueous hydroxyl polymer melt composition, of the present invention comprises a melt processed filament-forming polymer, such as a melt processed hydroxyl polymer, and a fast wetting surfactant according to the present invention.

The polymer melt compositions may have a temperature of from about 50° C. to about 100° C. and/or from about 65° C. to about 95° C. and/or from about 70° C. to about 90° C. when spinning filaments from the polymer melt compositions.

In one example, the polymer melt composition of the present invention may comprise from about 30% and/or from about 40% and/or from about 45% and/or from about 50% to about 75% and/or to about 80% and/or to about 85% and/or to about 90% and/or to about 95% and/or to about 99.5% by weight of the polymer melt composition of a filament-forming polymer, such as a hydroxyl polymer. The filament-forming polymer, such as a hydroxyl polymer, may have a weight average molecular weight greater than 100,000 g/mol In one example, the filaments of the present invention produced via a polymer processing operation may be cured at a curing temperature of from about 110° C. to about 260° C. and/or from about 110° C. to about 230° C. and/or from about 120° C. to about 200° C. and/or from about 130° C. to about 185° C. for a time period of from about 0.01 and/or 1 and/or 5 and/or 15 seconds to about 60 minutes and/or from about 20 seconds to about 45 minutes and/or from about 30 seconds to about 30 minutes. Alternative curing methods may include radiation methods such as UV, e-beam, IR and other temperature-raising methods.

Further, the filaments may also be cured at room temperature for days, either after curing at above room temperature or instead of curing at above room temperature.

The filaments of the second layer may include melt spun filaments and/or spunbond filaments, hollow filaments, shaped filaments, such as multi-lobal filaments and multicomponent filaments, especially bicomponent filaments. The multicomponent filaments, especially bicomponent filaments, may be in a side-by-side, sheath-core, segmented pie, ribbon, islands-in-the-sea configuration, or any combination thereof. The sheath may be continuous or non-continuous around the core. The ratio of the weight of the sheath to the core can be from about 5:95 to about 95:5. The fibers of the present invention may have different geometries that include round, elliptical, star shaped, rectangular, and other various eccentricities.

Surface Softening Composition

In one example, the surface softening composition comprises one or more quaternary ammonium compounds, for example greater than 25% and/or greater than 30% and/or greater than 35% and/or greater than 40% and/or greater than 25% to about 70% and/or greater than 30% to about 70% and/or greater than 35% to about 70% and/or greater than 40% to about 70% and/or greater than 40% to about 65% and/or greater than 40% to about 60% and/or greater than 40% to about 55% by weight of the quaternary ammonium compound and optionally water, for example less than 75% and/or less than 70% and/or less than 65% and/or less than 60% and/or less than 50% and/or less than 45% and/or less than 40% and/or from about 25% to less than 75% and/or from about 30% to less than 70% and/or from about 30% to less than 65% and/or from about 30% to less than 60% and/or from about 30% to less than 50% and/or from about 35% to less than 45% by weight of water, and optionally one or more surfactants, such as a nonionic and/or cationic surfactant, for example a nonionic surfactant, capable of creating forming vesicles comprising the quaternary ammonium compound, for example multi-layered vesicles.

In one example, the surface softening composition of the present invention may comprise a plurality of vesicles 12 dispersed throughout a continuous phase 14, for example a continuous phase comprising the water. The vesicles 12 comprise the quaternary ammonium compound and may further comprise water present within the vesicles 12. It has unexpectedly been found that by limiting the initial amount of water in the water and quaternary ammonium compound mixture such that the weight ratio of quaternary ammonium compound to initial water is greater than 2.25:1 and/or greater than 2.3:1 and/or greater than 2.35:1 and/or at least 2.4:1 and/or at least 2.5:1 and/or at least 2.75:1 and/or at least 3:1 and/or subjecting the mixture of the quaternary ammonium compound and water to cooling, for example subjecting the mixture to a temperature of less than 50° C. and/or less than 45° C. and/or less than 40° C. and/or less than 35° C. and/or less than 30° C. and/or greater than 0° C. and/or greater than 10° C. and/or greater than 15° C. and/or greater than 20° C., during the method of making the surface softening composition of the present invention, the vesicles 12 formed in the mixture exhibit a narrower average particle size distribution.

In one example, the surface softening composition exhibits an average particle size distribution of from about 100 nm to about 50 μm and/or from about 1 to about 50 μm and/or from about 1 to about 20 μm and/or from about 1 to about 15 μm and/or from about 1 to about 6 μm.

The pH of such surface softening compositions may be less than 6 and/or less than 5.5 and/or less than 5 and/or less than 4.5 and/or greater than 2 and/or greater than 2.5 and/or greater than 3 and/or about 3.5 to about 4.5.

In one example, the surface softening compositions of the present invention provide consumer products, such as fibrous structures, for example sanitary tissue products, such as toilet tissue, and/or textiles, such as fabrics, and/or nonwovens, improved tactile sensation perceived by the user or wearer. Such tactile perceivable softness can be characterized by, but is not limited to, friction, flexibility, and smoothness, as well as subjective descriptors, such as a feeling like lubricious, velvet, silk or flannel.

a. Quaternary Ammonium Compounds

Non-limiting examples of suitable quaternary ammonium compounds for use in the surface softening compositions of the present invention include quaternary ammonium compounds that exhibit a melting point of greater than 30° C. and/or greater than 35° C. and/or at least 38° C.

Non-limiting examples of suitable quaternary ammonium compounds for use in the surface softening compositions of the present invention include, but are not limited to, quaternary ammonium compounds having the formula:

Formula I

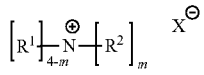

wherein:

m is 1 to 3; each $R^1$ is independently a $C_1$-$C_6$ alkyl group, hydroxyalkyl group, hydrocarbyl or substituted hydrocarbyl group, alkoxylated group, benzyl group, alkenyl group, or mixtures thereof; each $R^2$ is independently a $C_{14}$-$C_{22}$ alkyl group, hydroxyalkyl group, hydrocarbyl or substituted hydrocarbyl group, alkoxylated group, benzyl group, alkenyl group, or mixtures thereof; and $X^-$ is any compatible anion.

In one example, $X^-$ may be selected from the group consisting of: acetate, chloride, bromide, methyl sulfate, formate, sulfate, nitrate, and mixtures thereof. In another example, $X^-$ is chloride or methyl sulfate. In yet another example, $X^-$ is chloride. In still another example, $X^-$ is methyl sulfate.

In one example, each $R^1$ is independently a $C_1$-$C_6$ alkyl or alkenyl group or mixtures thereof, for example each $R^1$ is independently a $C_1$-$C_6$ alkyl group or mixtures thereof, such as a methyl group.

In one example, each $R^2$ is independently a $C_{16}$-$C_{18}$ alkyl or alkenyl group or mixtures thereof, for example each $R^2$ is independently a straight-chain $C_{16}$-$C_{18}$ alkyl or alkenyl group or mixtures thereof, such as a straight-chain $C_{18}$ alkyl or alkenyl group or mixtures thereof.

In another example, each $R^2$ is independently a $C_{16}$-$C_{18}$ alkyl group or mixtures thereof, for example each $R^2$ is independently a straight-chain $C_{16}$-$C_{18}$ alkyl group or mixtures thereof, such as a straight-chain $C_{18}$ alkyl group.

Optionally, the each $R^2$ may be derived from vegetable oil sources. Several types of the vegetable oils (e.g., olive, canola, safflower, sunflower, etc.) can used as sources of fatty acids to synthesize the quaternary ammonium compounds of the present invention. Branched chain actives (e.g., made from isostearic acid) are also effective.

In yet another example, the quaternary ammonium compound of the present invention may be an ester variant, such as a mono-, di-, or trimester variant. Examples of such quaternary ammonium compounds have the following formula:

$$(R^1)_{4-m}—N^+—[(CH_2)_n—Y—R^3]_mX^- \quad \text{Formula II}$$

wherein:

Y is independently —O—(O)C—, —C(O)—O—, —NH—C(O)—, or —C(O)—NH—, or mixtures thereof; m is 1 to 3; n is 0 to 4; each $R^1$ is independently a $C_1$-$C_6$ alkyl group, hydroxyalkyl group, hydrocarbyl or substituted hydrocarbyl group, alkoxylated group, benzyl group, alkenyl group, or mixtures thereof; each $R^3$ is independently a $C_{13}$-$C_{21}$ alkyl group, hydroxyalkyl group, hydrocarbyl or substituted hydrocarbyl group, alkoxylated group, benzyl group, alkenyl group, or mixtures thereof, and $X^-$ is a compatible anion.

In one example, $X^-$ may be selected from the group consisting of: acetate, chloride, bromide, methyl sulfate, formate, sulfate, nitrate, and mixtures thereof. In another example, $X^-$ is chloride or methyl sulfate. In yet another example, $X^-$ is chloride. In still another example, $X^-$ is methyl sulfate.

In one example, Y is independently —O—(O)C— or —C(O)—O—, or mixtures thereof; m is 2; and n is 2.

In one example, each $R^1$ is independently a $C_1$-$C_3$ alkyl or alkenyl group or mixtures thereof, for example each $R^1$ is independently a $C_1$-$C_3$ alkyl group or mixtures thereof, such as a methyl group.

In another example, each $R^3$ is independently a $C_{13}$-$C_{17}$ alkyl or alkenyl group or mixtures thereof, for example each $R^3$ is independently a $C_{15}$-$C_{17}$ alkyl or alkenyl group or mixtures thereof, such as a straight-chain $C_{15}$-$C_{17}$ alkyl or alkenyl group or mixtures thereof, for example a straight-chain $C_{17}$ alkyl or alkenyl group or mixtures thereof.

In yet another example, each $R^3$ is independently a $C_{13}$-$C_{17}$ alkyl group or mixtures thereof, for example each $R^3$ is a $C_{15}$-$C_{17}$ alkyl group or mixtures thereof, such as a straight-chain $C_{15}$-$C_{17}$ alkyl group or mixtures thereof, for example a straight-chain $C_{17}$ alkyl group.

Optionally, $R^3$ may be derived from vegetable oil sources. Several types of the vegetable oils (e.g., olive, canola, safflower, sunflower, etc.) can be used as sources of fatty acids to synthesize the quaternary ammonium compound. Non-limiting examples include olive oils, canola oils, high oleic safflower, and/or high erucic rapeseed oils can be used to synthesize the quaternary ammonium compounds of the present invention.

Non-limiting examples of ester-functional quaternary ammonium compounds of the present invention include dimethyl sulfate quaternized ester-alkyl ammonium salts having either methyl or ethylhydroxy groups occupying the remainder of the positions on the ammonical nitrogen not substituted with the ester-alkyl functionality. In one example, the quaternary ammonium compound is diester ditallow methyl ethylhydroxy ammonium methyl sulfate. Practical production of this molecule will invariably yield a certain fraction of a monoester-monotallow methyl di(ethylhydroxy) ammonium methyl sulfate and a certain fraction of triester tritallow methyl ammonium methyl sulfate, as well as a certain fraction of monoester, diester, and triester tertiary amines not methylated by the dimethyl sulfate during quaternization. A suitable product of this type has been obtained from Stepan Company as "Agent 2450-15". Another example of a suitable quaternary ammonium compound is diester ditallow dimethyl ammonium methyl sulfate, which analogously will be accompanied by a certain monoester-monotallow dimethyl ethylhydroxy ammonium methyl sulfate and the tertiary amine analogs of these two molecules not being methylated by the dimethyl sulfate.

In another example, the quaternary ammonium compounds of the present invention may be methylated by means of methyl chloride.

As mentioned above, typically, half of the fatty acids present in tallow are unsaturated, primarily in the form of oleic acid. Synthetic as well as natural "tallows" fall within the scope of the present invention. It is also known that depending upon the product characteristic requirements, the degree of saturation for such tallows can be tailored from non hydrogenated to partially hydrogenated or completely hydrogenated. All of above-described saturation levels are expressly meant to be included within the scope of the present invention.

It will be understood that substituents $R^1$, $R^2$ and $R^3$ may optionally be substituted with various groups such as alkoxyl, hydroxyl, or can be branched. In one example each $R^1$ independently methyl or hydroxyethyl. In one example, each $R^2$ is independently a $C_{12}$-$C_{18}$ alkyl and/or alkenyl, for example each $R^2$ is a straight-chain $C_{16}$-$C_{18}$ alkyl and/or alkenyl, such as each $R^2$ is independently a straight-chain $C_{18}$ alkyl or alkenyl. In one example, $R^3$ is a $C_{13}$-$C_{17}$ alkyl and/or alkenyl, such as a straight chain $C_{15}$-$C_{17}$ alkyl and/or alkenyl.

In one example, the quaternary ammonium compound is diethyl ester dimethyl ammonium methyl sulfate.

In another example, the quaternary ammonium compound is selected from the group consisting of: dialkyldialkylammonium salts and mixtures thereof.

In another example, the quaternary ammonium compound is selected from the group consisting of: dialkyldimethylammonium salts and mixtures thereof.

In one example, the quaternary ammonium compound comprises a dialkyldimethylammonium salt selected from the group consisting of: mono-ester variants of the dialkyldimethylammonium salt, diester variants of the dialkyldimethylammonium salt, and mixtures thereof.

In one example, the quaternary ammonium compound is selected from the group consisting of: diester ditallow dimethyl ammonium chloride, diester distearyl dimethyl ammonium chloride, monoester ditallow dimethyl ammonium chloride, diester di(hydrogenated)tallow dimethyl ammonium methyl sulfate, diester di(hydrogenated)tallow dimethyl ammonium chloride, monoester di(hydrogenated) tallow dimethyl ammonium chloride, diester di(non hydrogenated)tallow dimethyl ammonium chloride, diester di(touch hydrogenated)tallow dimethyl ammonium chloride (DEDTHTDMAC), diester di(hydrogenated)tallow dimethyl ammonium chloride (DEDHIDMAC), and mixtures thereof.

Such quaternary ammonium compounds may comprise dialkyldimethylammonium salts (e.g., ditallowdimethylammonium chloride, ditallowdimethylammonium methyl sulfate, di(hydrogenated tallow)dimethyl ammonium chloride, etc.) and trialkylmethylammonium salts (e.g., tritallowmethylammonium chloride, tritallowmethylammonium methyl sulfate, tri(hydrogenated tallow)methyl ammonium chloride, etc.), in which $R^1$ are methyl groups, $R^2$ of Formula I above are tallow groups of varying levels of saturation, and $X^-$ is chloride or methyl sulfate.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non-hydrogenated to partially hydrogenated or to completely hydrogenated. All of above-described saturation levels are expressly meant to be included within the scope of the present invention.

In one example, the quaternary ammonium compound is DEEDMAMS (diethyl ester dimethyl ammonium methyl sulfate), further defined herein wherein the hydrocarbyl chains are derived from tallow fatty acids optionally partially hardened to an iodine value from about 10 to about 60.

Furthermore, in one example, the ester-functional quaternary ammonium compounds of the present invention can optionally contain up to about 10% of the mono(long chain alkyl) derivatives, such as shown in the below formula:

$$(R^1)_2—N^+—((CH_2)_2OH)((CH_2)_2OC(O)R^3)X^-$$

as minor ingredients. These minor ingredients can act as emulsifiers.

In one example, depending on the quaternary ammonium compound chosen, the desired application level and other factors as may require a particular level of quaternary ammonium compound in the surface softening composition, the level of quaternary ammonium compound may vary between about 10% of the composition and about 60% of the composition. In one example, the surface softening composition comprises between about 25% and about 50% and/or between about 30% and about 45% by weight of the quaternary ammonium compound.

Non-limiting examples of quaternary ammonium compounds suitable for use in the present invention further include either unmodified, or mono- or di-ester variations of well-known dialkyldimethylammonium salts and alkyltrimethyl ammonium salts. Examples include the di-ester variations of di(hydrogenated tallow)dimethyl ammonium methylsulphate and di-ester variations of di(hydrogenated tallow) dimethyl ammonium chloride. Without wishing to be bound by theory, it is believed that the ester moity(ies) lends biodegradability to these compounds. Commercially available materials are available from Witco Chemical Company Inc. of Dublin, Ohio, under the tradename "Rewoquat V3512". Details of analytical and testing procedures are given in WO95/11343, published on 27 Apr. 1995.

b. Surfactant

One or more surfactants and/or two or more surfactants, for example at least one surfactant that functions as a bilayer disrupter, may be added to the surface softening composition of the present invention, such as to the water to form a premix prior to the addition of the quaternary ammonium compound, for example a quaternary ammonium compound in molten form.

Surfactants useful in the compositions of the present invention are surface active materials. Such materials comprise both hydrophobic and hydrophilic moieties. In one example, a hydrophilic moiety is a polyalkoxylated group, such as a polyethoxylated group.

The surfactants may be present in the surface softening composition at a level of between about 1% and about 20% and/or between about 2% and about 15% and/or between about 3% and about 10% by weight of the level of the quaternary ammonium compound.

Non-limiting examples of suitable surfactants include nonionic surfactants derived from saturated and/or unsaturated primary and/or secondary, amine, amide, amine-oxide fatty alcohol, fatty acid, alkyl phenol, and/or alkyl aryl carboxylic acid compounds, for example each having from about 6 to about 22 and/or from about 8 to about 18 carbon atoms in a hydrophobic chain, and/or an alkyl or alkylene chain, wherein at least one active hydrogen of said compounds is ethoxylated with ≤50 and/or ≤30 and/or from about 3 to about 15 and/or from about 5 to about 12 ethylene oxide moieties to provide an HLB of from about 6 to about 20 and/or from about 8 to about 18 and/or from about 10 to about 15. A more complete description of suitable surfactants for use in the surface softening compositions of the present invention can be found in WO 00/22231. In one example, at least one of the surfactants comprises HLB value of less than 12 and/or less than 10 and/or less than 8 and/or less than 12 but greater than 1 and/or less than 10 but greater than 3 and/or less than 8 but greater than 4.

In one example, at least one of the surfactants present in the surface softening composition comprises HLB value of at least 14 and/or at least 15 and/or at least 18 and/or at least 20 and/or at least 14 but less than 25 and/or at least 15 but less than 25 and/or at least 15 but less than 20.

In one example, at least one of the surfactants is selected from the group consisting of: nonionic surfactants, cationic surfactants, and mixtures thereof. In one example, at least one of the surfactants comprises a nonionic surfactant, for example an alcohol ethoxylate, such as a $C_9$-$C_{11}$ alcohol ethoxylate.

In one example, the nonionic surfactant comprises a polyhydroxy fatty acid amide surfactant.

In one example, the surface softening composition comprises from about 0.1 to about 5% and/or from about 0.1 to about 3% and/or from about 0.3 to about 2% and/or from about 0.3 to about 1.5% and/or from about 0.3 to about 1% and/or from about 0.5 to about 0.75% by weight of the one or more surfactants.

Optional Components of the Surface Softening Composition

Any salt (electrolyte) meeting the general criteria described above for materials suitable for use in the vehicle of the present invention and which is effective in reducing the viscosity of a dispersion of a softening active ingredient in water is suitable for use in the vehicle of the present invention. In particular, any of the known water-soluble electrolytes meeting the above criteria may be included in the vehicle of the surface softening composition of the present invention. When present, the electrolyte can be used in amounts up to about 25% by weight of the surface softening composition, but preferably no more than about 15% by weight of the surface softening composition. Preferably, the level of electrolyte is between about 0.1% and about 10% by weight of the surface softening composition based on the anhydrous weight of the electrolyte. Still more preferably, the electrolyte is used at a level of between about 0.3% and about 1.0% by weight of the surface softening composition. The minimum amount of the electrolyte will be that amount sufficient to provide the desired viscosity. Suitable electrolytes include the halide, nitrate, nitrite, and sulfate salts of alkali or alkaline earth metals, as well as the corresponding ammonium salts. Other useful electrolytes include the alkali and alkaline earth salts of simple organic acids such as sodium formate and sodium acetate, as well as the corresponding ammonium salts. Preferred inorganic electrolytes include the chloride salts of sodium, calcium, and magnesium. Calcium chloride is a particularly preferred inorganic electrolyte for the surface softening composition of the present invention. A particularly preferred organic acid salt-based electrolyte is sodium formate.

In addition to salts (electrolytes), the surface softening composition may further comprise one or more optional ingredients selected from the group consisting of: salts, anti-foaming agents, pH adjusting agents, dispersing agents, chelating agents, and mixtures thereof.

Method for Making Surface Softening Composition

In one example, the surface softening compositions of the present invention may be made as follows:

a. adding a quaternary ammonium compound, for example a quaternary ammonium compound in molten form, such as a quaternary ammonium compound above its melting point, to water, for example cold water, such as water at 23° C. or less but greater than 0° C. and/or greater than 10° C., to form a mixture; and
b. cooling the mixture such that the surface softening compositions of the present invention are produced.

In one example, the step of adding the quaternary ammonium compound to the water results in the mixture exhibiting a weight ratio of quaternary ammonium compound to water of greater than 2.25:1.

In one example, greater than 25% by weight of the surface softening composition of the quaternary ammonium compound is added to less than 75% by weight of the surface softening composition of water to form the mixture.

In one example, one or more surfactants of the present invention may be added to the water prior to adding the quaternary ammonium compound to the water. In addition to the one or more surfactants, an anti-foaming agent and/or pH adjusting agent and/or a salt (electrolyte) and/or a dispersing agent and/or a chelating agent may be added to the water and/or mixture.

A plurality of vesicles are formed in the mixture formed by step a. The vesicles are dispersed throughout a continuous phase, for example the water or at least a portion of the water.

The step of cooling may comprise subjecting the mixture to a temperature of about 50° C. or less and/or from about 50° C. to greater than 10° C. and/or from about 45° C. to greater than 15° C. and/or from about 40° C. to greater than 20° C.

Non-Limiting Examples of Fibrous Structures

The materials used in the Examples below are as follows:

Amioca starch is a waxy corn starch with a weight average molecular weight greater than 30,000,000 g/mol supplied by Ingredion.

Hyperfloc NF301, a nonionic polyacrylamide (PAAM) has a weight average molecular weight between 5,000,000 and 6,000,000 g/mol, is supplied by Hychem, Inc., Tampa, FL Aerosol OT-70 is an anionic sodium dihexyl sulfosuccinate surfactant supplied by Cytec Industries, Inc., Woodland Park, NJ Malic acid and ammonium methanesulfonate are supplied as 10 wt % and 35 wt % solutions respectively from Calvary Industries, Fairfield, OH.

Comparative Example 1

2-ply Wet laid TAD structure coated with softening chemistry (quat softener). The resulting product has low softness, low glide, and high pilling (~lint)

A comparative example of making a toilet tissue product consisting of 2 plies of wet laid through-air-dried (TAD) fibrous structures is described. Two aqueous slurries of wood pulp fibers: 1) an aqueous slurry of eucalyptus wood pulp fibers, and 2) an aqueous slurry of a mixture of eucalyptus wood pulp fibers and softwood pulp fibers are supplied to different headboxes and/or supplied to a layered headbox, The aqueous slurries are then delivered to a Fourdrinier wire (also sometimes referred to as a forming wire) to produce an embryonic layered fibrous structure having a wire layer (layer in contact with the Fourdrinier wire) composed of eucalyptus wood pulp fibers and an air layer composed of a blend of eucalyptus wood pulp fibers and softwood pulp fibers. The embryonic layered fibrous structure is composed of 35% eucalyptus wood pulp fibers in the wire layer and 65% blend of eucalyptus wood pulp fibers and softwood pulp fibers in the air layer. After deposition on the Fourdrinier wire, the embryonic fibrous structure is partially dried with vacuum boxes operated at −10 in $H_2O$, and then brought into contact with a patterned molding member, such as a 3D patterned through air drying belt at which point the wood pulp fibers are deflected into the pillows of the patterned belt, followed by further dewatering of the fibrous structure. Transfer of the fibrous structure to the patterned molding member may be assisted with a forming vacuum operated between −6 to −15 in $H_2O$. Once at least a portion of the wood pulp fibers have been deflected and molded into the patterned molding member, the fibrous structure, while being carried on the patterned molding member, is then passed through a pre-dryer at 320° F. (TAD process), where the fibrous structure is further dried. The fibrous structure is then adhered to the Yankee dryer where it is dried to a consistency of about 95%. A creping blade set at a 81° impact angle is used to both remove the fibrous structure from the Yankee dryer and foreshorten the sheet with 11.5% crepe to add dry stretch into the fibrous structure. Finally, the fibrous structure is passed through a set of calendaring rolls before being wound into a fibrous structure parent roll.

The fibrous structure from the fibrous structure parent roll made above is then combined with another fibrous structure from another fibrous structure parent roll, which may be the same or different as the first fibrous structure parent roll, and made into a 2-ply fibrous structure product, in this case a 2-ply toilet tissue product. The separate parent rolls are unwound, laminated and embossed to form a 2-ply fibrous structure, for example a 2-ply toilet tissue product, and then a softening chemistry, for example a quaternary ammonium softening agent, is applied to the embossed side of at least one of the fibrous structures at 20 lb/ton using a slot extrusion process. The 2-ply toilet tissue product is wound and then tail sealed and cut to width to create a finished product roll of toilet tissue product. The resulting 2-ply toilet tissue product has a Peak Load of 8.8 g as measured by the Glide Test Method—4 Inch Sample, a TS7 value of 9.4 dB $V^2$ rms as measured by the Emtec Test Method, and a pilling value of 2000 $mm^3$ as measured by the Pilling Test Method. The 2-ply toilet tissue product has a peak load value of 5.6 g as measured by the Glide Test Method—4 Inch Sample. As described in this Comparative Example, this TAD structure contains no filaments, exhibits a low Peak Load value and a low Dual Surface Glide value and is considered too slippery.

Comparative Example 2

2-ply TAD structure where a starch layer and PVOH scrim layer is applied to the top wet laid TAD ply, and no softening chemistry is added. This product has high softness, high glide, and low lint In a 40:1 APV Baker twin-screw extruder with eight temperature zones, Amioca starch is mixed with Aerosol OT-70 surfactant, malic acid and water in Zone 1. This mixture is then conveyed down the barrel through zones 2 through 8 and cooked into a melt-processed hydroxyl polymer composition. The composition in the extruder is 35% water where the make-up of solids is 99.4% Amioca, 0.5% Aerosol OT-70, and 0.1% malic acid. The extruder barrel temperature setpoints for each zone are shown below.

| Zone | 1 | 2 | 3 | 4 | 5 | 6 | 7 | 8 |
|---|---|---|---|---|---|---|---|---|
| Temperature (° F.) | 60 | 60 | 60 | 120 | 320 | 320 | 320 | 320 |

The temperature of the melt exiting the 40:1 extruder is between 320 and 330° F. From the extruder, the melt is fed to a Mahr gear pump, and then delivered to a second extruder. The second extruder is a 13:1 APV Baker twin screw, which serves to cool the melt by venting a stream to atmospheric pressure. The second extruder also serves as a location for additives to the hydroxyl polymer melt. Particularly, a stream of 2.2 wt % Hyperfloc NF301 polyacrylamide is introduced at a level of 0.1% on a solids basis. The material that is not vented is conveyed down the extruder to a second Mahr melt pump. From here, the hydroxyl polymer melt is delivered to a series of static mixers where a cross-linker and water are added. The melt composition at this point in the process is 50-60% total solids. On a solids basis the melt is comprised of 92.4% Amioca starch, 5.5% cross-linking agent, 1.0% ammonium methanesulfonate, 1.0% surfactant, 0.1% Hyperfloc NF301, and 0.1% malic acid. From the static mixers the composition is delivered to a melt blowing spinneret via a melt pump.

A plurality of starch filaments is attenuated with a saturated air stream to form a 2 gsm layer of starch filaments that are collected on directly on top of a 25 gsm wet laid fibrous structure to form a starch filament layer/wet laid fibrous structure layer composite structure, where the starch filaments exhibit an average diameter of about 5.3 μm. After applying the starch filaments to the wet laid fibrous structure, a plurality of PVOH filaments are spun directly onto the starch filament layer to form a 0.25 gsm layer of PVOH filaments, a scrim layer, resulting in a layered fibrous structure. The PVOH filaments are prepared as follows:

Poval 10-98 polyvinyl alcohol (98% hydrolysis Kuraray) having a weight average molecular weight of 50,000 g/mol and water are added into a scraped, wall pressure vessel equipped with an overhead agitator in order to target a 33 wt % PVOH melt. The 33 wt % solution is cooked under pressure at 240° F. for 4 hours until the resulting melt is homogenous and transparent. The Poval 10-98 polyvinyl alcohol melt is pumped via gear pump to a melt blowing spinneret.

The plurality of PVOH filaments is attenuated with a saturated air stream to form a layer of PVOH filaments of 0.25 gsm that are collected directly on top of the starch filament layer of the starch filament layer/wet laid fibrous structure composite structure described previously and the PVOH filaments exhibit an average diameter of less than 3 μm. The resulting layered fibrous structure from top to bottom is 0.25 gsm PVOH filaments/2 gsm starch filaments/25 gsm wet laid fibrous structure. The resulting layered structure is then subjected to a thermal bonding process wherein bond sites are formed between the PVOH filaments and the starch filament layer and the wet laid fibrous structure. The thermal bond roll has a diamond shaped pattern with 13% bond area, and a 0.075 in. distance between bond sites. The thermal bonded, layered fibrous structure then passes into a 400° F. through-air convective oven with a residence time sufficient to activate the cross-linking agent in the starch filaments. The finished layered fibrous structure is then wound about a core to produce a parent roll. This parent roll is unwound and combined with a wet-laid fibrous structure ply from a wet laid fibrous structure parent roll using glue to form a 2-ply layered fibrous structure, such as a 2-ply toilet tissue product. The 2-ply toilet tissue product is wound and then tail sealed and cut to width to create a finished product roll of toilet tissue product. The resulting 2-ply toilet tissue product has a Peak Load of 150 gas measured by the Glide Test Method—4 Inch Sample, a TS7 value of 7.4 dB $V^2$ rms as measured by the Emtec Test Method, and a pilling value of less than 100 $mm^3$ as measured by the Pilling Test Method.

When dispensing from the 2-ply toilet tissue roll produced in Comparative Example 2 with a Peak Load of 150 g as measured according to the Glide Test Method—4 Inch Sample, it can be difficult for the tail end of the toilet tissue roll to freely release while spinning the toilet tissue roll. This can make it difficult to find the tail during dispensing of the toilet tissue from the toilet tissue roll, which can result in consumer frustration. The high Peak Load (150 g) is due to a very high concentration of free PVOH fiber ends and PVOH fiber loops on the top ply of the 2-ply toilet tissue product that can interact with cellulose fibers on the bottom ply of the 2-ply toilet tissue product resting above and in contact with it on the convolutely wound toilet tissue roll. This creates a hook and loop interaction which holds the sheet(s) of 2-ply toilet tissue product to be dispensed onto the roll preventing it from readily dispensing when spinning the toilet tissue roll. This Comparative Example structure contains starch filaments with polyvinyl alcohol filaments in the form of a scrim and exhibits unacceptable roll dispensing due to its high Peak Load value much greater than 120 g; namely about 150 g.

Comparative Example 3

2-ply TAD structure where layer of PVOH applied to the top wet laid TAD ply, and no softening chemistry is added. This product has high softness, high glide, and low pilling (~lint)

A layered fibrous structure of continuous polyvinyl alcohol filaments spun and collected directly on a wet laid fibrous structure is prepared similarly to Comparative Example 2 with two differences. First, the starch processing step is eliminated, and second, the polyvinyl alcohol melt throughput is increased to deliver 1.3 gsm of spun fiber with an average diameter of 1-2 microns onto a 25 gsm wet laid cellulosic structure. The layered fibrous structure is passed through a thermal bond as in Example 2 however the structure is not cured. The finished layered fibrous structure is then wound about a core to produce a parent roll. This parent roll is combined with a wet-laid parent roll using glue to form a 2-ply layered fibrous structure, such as a 2-ply toilet tissue. The 2-ply toilet tissue product is wound and then tail sealed and cut to width to create a finished product roll of toilet tissue product. The resulting 2-ply toilet tissue product has a Peak Load of 294 g as measured by the Glide Test Method—4 Inch Sample, a TS7 value of 7.4 dB $V^2$ rms as measured by the Emtec Test Method, and a pilling value of less than 100 $mm^3$ as measured by the Pilling Test Method.

When dispensing from the 2-ply toilet tissue roll produced in Comparative Example 3 with a Peak Load of 294 g as measured according to the Glide Test Method—4 Inch Sample, it can be difficult for the tail end of the toilet tissue roll to freely release while spinning the toilet tissue roll. This can make it difficult to find the tail during dispensing of the toilet tissue from the toilet tissue roll, which can result in consumer frustration. This Comparative Example structure contains polyvinyl alcohol filaments (no starch filaments) present on a wet laid structure and exhibits unacceptable roll dispensing due to its high Peak Load value much greater than 120 g; namely about 294 g.

Comparative Example 4

2-Ply Tad Structure where a Starch Layer and PVOH Scrim Layer is Applied to the Top Wet Laid Tad Ply, and Softening Chemistry is Added. However, the Starch and PVOH Layers have a Low Level of Free Fiber Ends A layered fibrous structure ply comprising a layer of starch filaments, a layer of PVOH filaments (scrim layer), and wet laid fibrous structure layer is made as described in Comparative Example 2, however the basis weight of the starch filaments is reduced from 2.0 gsm to 1.6 gsm, and the starch filaments average diameter is increased from 5.3 μm to 6.5 μm, which decreases the number and/or concentration of starch free fiber ends and fiber loops. The layered fibrous structure ply is wound and then unwound and combined using a ply bond glue with a wet-laid fibrous structure ply that is unwound from a wet laid fibrous structure parent roll. A softening chemistry, for example a quaternary softening agent, is slot coated onto the layered fibrous structure ply with a slot extrusion process at 20 lb/metric ton. The 2-ply toilet tissue product is wound and then tail sealed and cut to width to create a finished product roll of toilet tissue. The resulting 2-ply toilet tissue product has a low Peak Load of less than 25 g; namely 16 g as measured by the Glide Test Method—4 Inch Sample and is perceived by consumers as being too slippery resulting in poor cleaning and absorbency performance.

The relatively low Peak Load from the Glide Test Method is because there are very few free starch and PVOH fiber ends and starch and PVOH fiber loops which can interact with a surface gliding across the toilet tissue product, for example skin. Consequently, this product is perceived as slippery/slick which can result in poor bowel movement cleaning performance during consumer use. Without the free fiber ends and fiber loops interaction with skin there is no grip and grab counteracting the smooth surface layer.

Comparative Example 5

2-Ply TAD Structure where a Starch Layer and PVOH Scrim Layer is Applied to the Top Wet Laid TAD Ply, and Softening Chemistry is Added. The Layered Fibrous Structure is Bonded with a Wide Spaced Thermal Bond Roll with a Low Bond Area with High Pilling (~Lint)

A layered fibrous structure of starch filaments, PVOH filaments, and wet laid cellulosic layer is made as described in Comparative Example 4, however the PVOH, starch, and wet laid layers are bonded together with a low bond area, wide spaced thermal bonding process. The thermal bond roll has a dot pattern with 2.6% bond area, and a 0.188 in.

distance between bond sites. The layered fibrous structure composed of starch and PVOH filaments layered on cellulosic wet laid substrate is combined with a wet-laid parent roll using ply glue, and then a quat softener is added to the top ply with a slot extrusion process at 20 lb/metric ton. The 2-plies are wound together and then tail sealed and cut to width to create a finished product roll of toilet tissue. The resulting product has a pilling value greater than 2000 $mm^3$ as measured by the Pilling Test Method, which is an unacceptable pilling level from a consumer use standpoint.

Inventive Example 1

2-Ply TAD Structure where a Starch Layer and PVOH Scrim Layer is Applied to the Top Wet Laid TAD Ply, and Softening Chemistry is Added. This Product has High Softness, Low Glide, and Low Pilling (~Lint)

A layered fibrous structure ply comprising a layer of starch filaments, a layer of PVOH filaments (scrim layer), and wet laid fibrous structure layer is made as described in Comparative Example 2, however a softening chemistry is slot coated onto the layered fibrous structure ply during converting into the 2-ply toilet tissue product. The layered fibrous structure composed of a layer of starch filaments and PVOH scrim filaments layered on cellulosic wet laid substrate is combined with a wet-laid parent roll using ply glue, and then a quat softener is added to the top ply with a slot extrusion process at 20 lb/metric ton. The 2 plies are wound together and then tail sealed and cut to width to create a finished product roll of toilet tissue. The resulting product has a Peak Load of 31 g as measured by the Glide Test Method—4 Inch Sample, a TS7 value of 8.1 dB $V^2$ rms as measured by the Emtec Test Method, and a pilling value of 195 $mm^3$ as measured by the Pilling Test Method.

Inventive Example 2

2-Ply TAD Structure where Layer of PVOH Applied to the Top Wet Laid TAD Ply, and Softening Chemistry is Added. This Product has High Softness, Optimum Glide, and Low Pilling (~Lint)

A layered fibrous structure of PVOH filaments spun onto wet laid cellulosic layer is made as described in Comparative Example 3, however slot coated softening chemistry is added to the top ply of the 2-ply product in converting. The layered fibrous structure composed of PVOH filaments layered on cellulosic wet laid substrate is combined with a wet-laid parent roll using ply glue, and then a quat softener is added to the top ply with a slot extrusion process at 20 lb/metric ton. The 2-plies are wound together and then tail sealed and cut to width to create a finished product roll of toilet tissue. The resulting product has a Peak Load of 48 g as measured by the Glide Test Method—4 Inch Sample, a TS7 value of 6.0 dB $V^2$ rms as measured by the Emtec Test Method, and a pilling value less than 100 $mm^3$ as measured by the Pilling Test Method.

This product has an optimum Peak Load value of greater than 25 g but less than 120 g; namely 48 g as measured by the Glide Test Method—4 Inch Sample. The Peak Load value is not too high as in Comparative Examples 2 and 3 such that roll dispensing is a negative for consumers nor too low as in Comparative Example 4 such that the surface is too slippery for good bowel movement cleaning performance. There is a moderate concentration of free PVOH fiber ends and PVOH fiber loops because the addition of the slot coated softener compresses down some of the free fiber ends and loops which prevents roll blocking/roll dispensing issues, while retaining a critical amount of fiber ends and loops for sufficient grip and grab during wiping.

Inventive Example 3

2-Ply TAD Structure where Layer of PVOH Applied to the Top Ply, and Softening Chemistry is Added. The Layered Fibrous Structure is Bonded with a Wide Spaced Thermal Bond Roll with a Low Bond Area with Low Pilling (~Lint)

A layered fibrous structure of PVOH filaments spun onto wet laid cellulosic layer is made as described in Inventive Example 5, however the PVOH and wet laid layers are bonded together with a low bond area, wide spaced thermal bonding process. The thermal bond roll has a dot pattern with 2.6% bond area, and a 0.188 in. distance between bond sites. The layered fibrous structure composed of PVOH filaments layered on cellulosic wet laid substrate is combined with a wet-laid parent roll using ply glue, and then a quat softener is added to the top ply with a slot extrusion process at 20 lb/metric ton. The 2 plies are wound together and then tail sealed and cut to width to create a finished product roll of toilet tissue. The resulting product has a TS7 dB $V^2$ rms value of 6.0 as measured by the Emtec Test Method, and a pilling value less than 100 $mm^3$ as measured by the Pilling Test Method.

Inventive Example 4

2-Ply TAD Structure where a Starch Layer and PVOH Scrim Layer is Applied to the Top Ply, and Softening Chemistry is Added. This Product has High Softness, Optimum Glide, and Low Lint A layered fibrous structure of starch filaments, PVOH filaments, and wet laid cellulosic layer is made as described in Comparative Example 2, however slot coated softening chemistry is added to the top ply of the 2-ply product in converting. The layered fibrous structure composed of starch and PVOH scrim filaments layered on cellulosic wet laid substrate is combined with a wet-laid parent roll using ply glue, and then a quat softener is added to the top ply with a slot extrusion process at 20 lb/metric ton. The 2-plies are wound together and then tail sealed and cut to width to create a finished product roll of toilet tissue. The resulting product has a peak load of 49 g as measured by the Glide Test Method—4 Inch Sample, a TS7 value of 6.5 dB $V^2$ rms as measured by the Emtec Test Method, and a pilling value of 268 $mm^3$ as measured by the Pilling Test Method.

This product has an acceptable Peak Load value of greater than 25 g but less than 120 g; namely 49 g as measured by the Glide Test Method. The Peak Load value is not too high as in Comparative Examples 2 and 3 such that roll dispensing is a negative for consumers nor too low as in Comparative Example 4 such that the surface is too slick for good bowel movement cleaning performance. There is a moderate concentration of free PVOH fiber ends and PVOH fiber loops because the addition of the slot coated softener compresses down some of the free fiber ends and loops which prevents roll blocking/roll dispensing issues, while retaining a critical amount of fiber ends and loops for sufficient grip and grab during wiping.

Table 1 below provides data and consumer responses for some of the Comparative Examples and Inventive Examples above.

TABLE 1

| Example | Peak Load (g) from Glide Test Method - 4 Inch Sample | Consumer Response |
|---|---|---|
| Comparative Example 2 | 150 | Roll dispensing frustration/cannot find tail for easy dispensing |
| Comparative Example 3 | 294 | Roll dispensing frustration/cannot find tail for easy dispensing |
| Comparative Example 4 | 16 | Product is perceived as slick resulting in poor cleaning and absorbency performance |
| Inventive Example 2 | 48 | Good combination of softness, roll dispensing behavior, and cleaning performance |
| Inventive Example 4 | 49 | Good combination of roll dispensing behavior, softness, and cleaning performance |

Test Methods

Unless otherwise specified, all tests described herein including those described under the Definitions section and the following test methods are conducted on samples that have been conditioned in a conditioned room at a temperature of 23° C.±1.0° C. and a relative humidity of 50%±2% for a minimum of 24 hours prior to the test. All plastic and paper board packaging articles of manufacture, if any, must be carefully removed from the samples prior to testing. The samples tested are "usable units." "Usable units" as used herein means sheets, flats from roll stock, pre-converted flats, fibrous structure, and/or single or multi-ply products. Except where noted all tests are conducted in such conditioned room, all tests are conducted under the same environmental conditions and in such conditioned room. Discard any damaged product. Do not test samples that have defects such as wrinkles, tears, holes, and like. All instruments are calibrated according to manufacturer's specifications.

Basis Weight Test Method

Basis weight of a fibrous structure is measured on stacks of twelve usable units using a top loading analytical balance with a resolution of ±0.001 g. The balance is protected from air drafts and other disturbances using a draft shield. A precision cutting die, measuring 8.890 cm±0.00889 cm by 8.890 cm±0.00889 cm is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in g/m$^2$ as follows:

Basis Weight=(Mass of stack)/[(Area of 1 square in stack)×(No.of squares in stack)]

Basis Weight (g/m$^2$)=Mass of stack (g)/[79.032 (cm$^2$)/10,000 (cm$^2$/m$^2$)×12]

Report result to the nearest 0.1 g/m$^2$. Sample dimensions can be changed or varied using a similar precision cutter as mentioned above, so as at least 645 square centimeters of sample area is in the stack.

Emtec Test Method

TS7 and TS750 values are measured using an EMTEC Tissue Softness Analyzer ("Emtec TSA") (Emtec Electronic GmbH, Leipzig, Germany) interfaced with a computer running Emtec TSA software (version 3.19 or equivalent). According to Emtec, the TS7 value correlates with the real material softness, while the TS750 value correlates with the felt smoothness/roughness of the material. The Emtec TSA comprises a rotor with vertical blades which rotate on the test sample at a defined and calibrated rotational speed (set by manufacturer) and contact force of 100 mN. Contact between the vertical blades and the test piece creates vibrations, which create sound that is recorded by a microphone within the instrument. The recorded sound file is then analyzed by the Emtec TSA software. The sample preparation, instrument operation and testing procedures are performed according the instrument manufacture's specifications.

Sample Preparation

Test samples are prepared by cutting square or circular samples from a finished product. Test samples are cut to a length and width (or diameter if circular) of no less than about 90 mm, and no greater than about 120 mm, in any of these dimensions, to ensure the sample can be clamped into the TSA instrument properly. Test samples are selected to avoid perforations, creases or folds within the testing region. Prepare 8 substantially similar replicate samples for testing. Equilibrate all samples at TAPPI standard temperature and relative humidity conditions (23° C.±2 C.° and 50%±2%) for at least 1 hour prior to conducting the TSA testing, which is also conducted under TAPPI conditions.

Testing Procedure

Calibrate the instrument according to the manufacturer's instructions using the 1-point calibration method with Emtec reference standards ("ref.2 samples"). If these reference samples are no longer available, use the appropriate reference samples provided by the manufacturer. Calibrate the instrument according to the manufacturer's recommendation and instruction, so that the results will be comparable to those obtained when using the 1-point calibration method with Emtec reference standards ("ref.2 samples").

Mount the test sample into the instrument, and perform the test according to the manufacturer's instructions. When complete, the software displays values for TS7 and TS750. Record each of these values to the nearest 0.01 dB V$^2$ rms. The test piece is then removed from the instrument and discarded. This testing is performed individually on the top surface (outer facing surface of a rolled product) of four of the replicate samples, and on the bottom surface (inner facing surface of a rolled product) of the other four replicate samples.

The four test result values for TS7 and TS750 from the top surface are averaged (using a simple numerical average); the same is done for the four test result values for TS7 and TS750 from the bottom surface. Report the individual average values of TS7 and TS750 for both the top and bottom surfaces on a particular test sample to the nearest 0.01 dB V$^2$ rms. Additionally, average together all eight test value results for TS7 and TS750, and report the overall average values for TS7 and TS750 on a particular test sample to the nearest 0.01 dB V$^2$ rms.

Pilling Test Method

1. Apparatus

Rub Tester Sutherland Ink Rub Tester—Cam A Special available from Danilee Co. 16350 Blanco Road, Suite 117-138, San Antonio, Texas, 78232. A scoring device and a five-pound weight are included. It has four square inches of effective contact area which provides a contact pressure of 1.25 pounds per square inch. The five-pound weight is used with 3 rubber pads 2×1 in. (51×25.4 mm) described below. The five-pound weight rubber pads are cut to their size, being careful not to shear the rubber material during cutting. Double-sided tape is used to attach the rubber pads to the five-pound weight by placing 2 of the 3 rubber pads ⅛ inch inward from the outer edges of the five-pound weight and the remaining rubber pad is centered between the 2 on the five-pound weight. The rub tester base is used with a 6×2½ in. (152×63.5 mm) rubber pad described below. The rub tester base rubber pad is cut to its size, being careful not to shear the rubber material during cutting. Line up with the cut edges and place double-sided tape #9589 to one side of the rubber pad. Cut the double-sided tape as needed with scissors to the rubber pad dimensions. Remove the backing on the double-sided tape, align the rubber pad with tape side down, and place the rubber pad on rub tester on the testing area.

Flatbed Scanner Fujitsu model fi-60, part number PA03595-B005, or equivalent.

Software Matlab R2014 or newer from MathWorks, Natick, MA

Cellophane Tape Any convenient source (e.g. Scotch tape), width ¾ inch (19.2 mm).

Book Tape 2 inch (50.8 mm) 3M #845, sub code 07383-0.

Double-Sided Tape 2 inch (50.8 mm) 3M #9589.

Rubber Pads Closed Cell Neoprene Sponge #311-n, no adhesive available from Cincinnati Gasket Packing and Mfg., Inc., 40 Illinois Ave., Cincinnati, Ohio 45215-5586.

Alfa Cutter Catalog No. 240-7A or Catalog 240-7B or Catalog No. 240-10 available from Thwing-Albert Instrument Co. 14 Collings Ave., W. Berlin, NJ 08091 (856)-767-1000, or equivalent.

Paper Cutter Convenient Source, 12 inch×15 inch or larger

Cutting Dies 4.75 (MD)×5.0 in (CD). (114.3×127 mm), area precision: less than 0.2%, available from WDS, Harrison, Ohio. Die must be modified with soft foam rubber insert material.

Illustration Board "Cardboard" Crescent #300 available from XPDEX, 3131 Spring Grove Avenue, Cincinnati, OH 45225, 513-853-2176. Using a paper cutter, cut illustration board "cardboard" into 2½×6±⅛ in. sample cards. Cut a 4 in. piece of book tape. Align the tape with the top end of the card and attach centered within the sample card area with worded side of the sample card up. Wrap the tape so that the entire top 2 in. is sealed with the book tape. Insure book tape is securely attached to the sample card by rubbing firmly. Place book tape on the bottom end of the card in a similar manner.

Canned Air 8 oz. Pressurized Dust-Off Plus—VWR Scientific catalog #21899-092 and Valve #21899-103 or equivalent Black Felt, F-55 or equivalent available from New England Gasket, 550 Broad Street, Bristol, Conn. 06010. The black felt in use must be protected from light and conditioned in the controlled temperature and humidity room (23° C.±1.0° C. and RH 50%±2% for a minimum of two (2) hours).

2. Sample Preparation

For this method, a usable unit is described as one finished product unit regardless of the number of plies. Samples and black felts are conditioned with all wrapping or packaging materials removed in the controlled temperature and humidity room. Samples are to be conditioned for a minimum of ten minutes with no more than 2 layers. Black felt is thicker than the samples being measured and does not equilibrate in ten minutes, therefore the conditioning time will remain 2 hours (Black Felt only).

Finished Product—For new samples, discard at least 15 usable units from the roll or several usable units from a package. Use only usable units free of holes, tears, wrinkles, and other defects.

One, Two, and Three Ply Toilet Tissue—Remove a strip of toilet tissue three usable units long. Separate the units by carefully separating at the perforations. Stack and align three units for testing with the perforations at the top of the sample. The units should all be aligned in the machine direction and the outer sides facing the same direction. Make a second stack for the other side of the roll if requested.

Unconverted Stock—Cut into the reel or sample stack several plies deep to obtain a representative sample for testing. Using a paper cutter cut three strips 4.75 in.×5 in. with the 4.75 in. dimension running in the machine direction. Alternatively, an Alfa cutter with a correctly sized die can be used to cut the samples. For tissue containing specialty fibers which are primarily located on just one side, testing may be limited to the specialty side. Flip the sample stacks so that the side to be tested is down. Center a sample card on the stack with the 6 in. card dimension parallel to the machine direction of the sample. Carefully flip the sample stacks so that the sample card is down. Apply masking tape across the top and bottom of the stack. Each strip of tape should wrap around and attach to the back side of the card. The sample should be snug on the card, but be careful to not stretch or tear. If stretching or tearing occurs prepare another sample.

3. Testing

Set up the Sutherland Rub Tester according to the manufacturer's instructions. For this method, the tester is preset for three strokes and operates at Sutherland standard speed 2 (approximately 42 cycles per minute). A stroke is defined as one complete back and forth motion. Insure the instrument is delivering the correct number of strokes by starting the tester and counting. Monitor the stroke count frequently during testing. Place the five-pound weight so that the rubber pad side is up. Center a felt on the rubber pad and secure both ends with the available weight clamps. Place a prepared sample card on the base plate of the rub tester. Hook the five-pound weight onto the tester arm and gently lower onto the prepared sample card. Use a level to ensure the five-pound weight does not lean on the felt. It is important to check that the felt rests flat on the sample and that the five-pound weight does not bind on the tester arm.

Next, start the rub tester and at the end of three complete strokes remove the five-pound weight from the tester arm. If the sample is intact or only slightly torn, carefully remove the rubbed felt from the weight clamps. If the tissue sample is severely torn (a tear larger than 0.5 inch), retest. Repeat this procedure on all replicate samples. Remove and discard sample and tape from the sample cards. Black felt strips are used on only one side.

Scanning Protocol for used felts 1. Launch MatLab by clicking the correct icon on the system computer. 2. Type "npills" into the executable area of MatLab. A Graphical User Interface (GUI) will be launched. 3. Ensure that the cursor is in the "STN" cell of the GUI and that the "STN" cell is blank. 4. Select a single felt that has been rubbed. 5. Using canned air blow the scanner glass to remove any dust, etc. 6. Gently place felt rubbed-side down on the scanner body within the scanner bracket. 7. Gently place the bracket lid on the felt. 8. Click the green "Scan Felt" button on the GUI. The button will turn red and the program will complete the calculations, archive data, and fully reset by clearing the "STN" cell and placing the cursor in that cell. Finally, the "Scan Felt" button will return to green. 9. The system is ready for the next sample starting at step 4.

The image is acquired as an 8-bit gray scale 4×6 inch image at 600 dots per inch yielding an image that is 2400×3600 pixels in size. The left inch and right inch of this image contains a gray scale calibration scale (Kodak Color Separation and Gray Scale (Small) Cat #152 7654). The gray scale is attached to the custom scanner bracket. The gray scale is cropped from the image and shaped into a vector. The vector is plotted regressed against pixel count and a binomial curve is calculated for it. The coefficients for this curve are saved in the results spreadsheet. The center 2 inches of the image contains the image of the rubbed felt and the top may contain the sample label (see Image 3). The bottom inch of the image contains unrubbed felt. The remaining area contains the rubbed area of interest. This area is cropped from the total image and processed. The steps include; 1. A section of the gray scale (gray scale step 14) is cropped from the image and the average value in this cropped image is used as a thresholding value. A typical value for the threshold is 43±1. 2. The processed area is then thresholded using the calculated threshold value. This creates a black and white image where any pixel with a higher gray value than the threshold value is given a value of one and any pixel with a lower gray value than the threshold value is given a value of zero. 3. The Matlab function "regionprops", "Area" is enacted which assumes that any contiguous region of 1's is a unique object and the equivalent diameter of each unique object is calculated. The equivalent diameters are converted into equivalent radii (diameter/2) and the radii are used to calculate equivalent volumes (4/3*pi*r3) for each unique object. 4. The equivalent volumes are binned by size, are counted, and the bins are summed to calculate total volume in each bin. The bins are;

a. Anything volume greater than 100 $mm^3$.
b. Volumes greater than 50 but less than 100 $mm^3$.
c. Volumes greater than 10 but less than 50 $mm^3$.
d. Volumes greater than 1 but less than 10 $mm^3$.
e. Any volume less than 1 $mm^3$.

Average Diameter Test Method

This Average Diameter Test Method is used to determine the average diameters of fibrous elements, such as filaments and/or fibers, where their known average diameters are not already known. For example, average diameters of commercially available fibers, such as rayon fibers, have known lengths whereas average diameters of spun filaments, such as spun hydroxyl polymer filaments, would be determined as set forth immediately below. Further, pulp fibers, such as wood pulp fibers, especially commercially available wood pulp fibers would have known diameter (width) from the supplier of the wood pulp or are generally known in the industry and/or can ultimately be measured according to the Kajaani FiberLab Fiber Analyzer SubTest Method described below.

A fibrous structure comprising filaments of appropriate basis weight (approximately 5 to 20 grams/square meter) is cut into a rectangular shape sample, approximately 20 mm by 35 mm. The sample is then coated using a SEM sputter coater (EMS Inc, PA, USA) with gold so as to make the filaments relatively opaque. Typical coating thickness is between 50 and 250 nm. The sample is then mounted between two standard microscope slides and compressed together using small binder clips. The sample is imaged using a 10× objective on an Olympus BHS microscope with the microscope light-collimating lens moved as far from the objective lens as possible. Images are captured using a Nikon D1 digital camera. A Glass microscope micrometer is used to calibrate the spatial distances of the images. The approximate resolution of the images is 1 μm/pixel. Images will typically show a distinct bimodal distribution in the intensity histogram corresponding to the filaments and the background. Camera adjustments or different basis weights are used to achieve an acceptable bimodal distribution. Typically, 10 images per sample are taken and the image analysis results averaged.

The images are analyzed in a similar manner to that described by B. Pourdeyhimi, R. and R. Dent in "Measuring fiber diameter distribution in nonwovens" (Textile Res. J. 69(4) 233-236, 1999). Digital images are analyzed by computer using the MATLAB (Version. 6.1) and the MATLAB Image Processing Tool Box (Version 3.) The image is first converted into a grayscale. The image is then binarized into black and white pixels using a threshold value that minimizes the intraclass variance of the thresholded black and white pixels. Once the image has been binarized, the image is skeletonized to locate the center of each fiber in the image. The distance transform of the binarized image is also computed. The scalar product of the skeletonized image and the distance map provides an image whose pixel intensity is either zero or the radius of the fiber at that location. Pixels within one radius of the junction between two overlapping fibers are not counted if the distance they represent is smaller than the radius of the junction. The remaining pixels are then used to compute a length-weighted histogram of filament diameters contained in the image.

Kajaani FiberLab Fiber Analyzer SubTest Method

Instrument Start-Up:

1. Turn on Kajaani FiberLab Fiber Analyzer unit first, then computer and monitor.
2. Start FiberLab program on computer.

Instrument Operation:

1. File→New (or click on New File icon)
2. "New Fiber Analysis" screen pops up.
   a. Sample Point: select the folder you would like data stored in (to add a new folder see "Adding a New Folder"
   b. Name: add condition or sample name/identifier here
   c. Date
   d. Time
   e. Sample Weight: mg of dry fiber in the 50 ml sample (can leave blank if NOT measuring for coarseness). This is the number calculated in #10 of Sample Prep below.
3. Make sure 50 ml of sample is placed in a "Kajaani beaker" and click "Start"
4. Optional: Distribution→Measured Values
   a. Fibers: the final count of measured fibers should be at least 10,000
   b. Fibers/sec: this number must stay below 70 fibers/sec or the sample will automatically be diluted. If the sample is diluted during an analysis, the coarseness value will be invalid and will need to be discarded.
5. A bar indicating the measurement status of a sample appears on the computer monitor. Do not start an analysis until the indicated status is "Wait State". When the analysis is completed, wait for "Wait State" to appear, then close the "New Fiber Analysis" window. You can now repeat #1—¾
6. When finished with all samples, close the FiberLab program before turning off the Kajaani FiberLab analyzer unit.
7. Shutdown computer.

Sample Preparation:

Target Sample Size:

Softwood: 4 mg/50 ml→160 mg BD in 2000 ml (~170-175 mg from sheet)

Hardwood: 1 mg/50 ml→40 mg BD in 2000 ml (~40-45 mg from sheet)

1. For n=3 analysis, weigh and record weight of sample torn (avoiding cut edges) from 3 different pulp sheets of same sample using guidelines above for sample size. Place weighed samples into a suitable container for soaking of pulp.
2. Using the 3 sheets that samples were torn from, perform moisture content analysis. Note: This step can be skipped if coarseness measurement is not required.
3. Calculate the actual bone dry weight of the samples weighed in #1, by using the average moisture determined in #2.
4. Allow pulp samples to soak in water for 10-15 minutes.
5. Place 1$^{st}$ sample and soaking water into the Kajaani manual disintegrator. Fill disintegrator up to 250 ml mark with more water.
6. Using the "hand dasher", plunge up and down until sample is separated into individual fibers.
7. Transfer sample to a 2000 ml volumetric flask. Make sure to wash off and collect any fibers that may have adhered to the dasher.
8. Dilute up to 2000 ml mark. It is important to be as precise as possible for repeatable coarseness results.
9. Take a 50 ml aliquot and place into a Kajaani beaker. Place beaker on the sampler unit.
10. Calculate the mg of BD pulp in 50 ml aliquot
    a. (BD mg of sample/2000 ml)×50 ml
11. Begin Step #1 above in Instrument Operation The water used in this method is City of Cincinnati Water or equivalent having the following properties: Total Hardness=155 mg/L as $CaCO_3$; Calcium content=33.2 mg/L; Magnesium content=17.5 mg/L; Phosphate content=0.0462

Adding a New Folder to Sample Point Menu:

1. Settings→Common Settings→Sample Folders
   a. Type in name of new folder→Add→OK
   Note: You must close the FiberLab program and re-open program to see the new folder appear in the menu.

Collecting Data in Excel File:

1. Start FiberLab's Collect 1.12 program.
2. Open Windows Explorer (not to full screen—you must be able to see both the Explorer and the Collect windows.
3. In Windows Explorer . . . Select folder that data was stored in
4. Highlight data to be put in Excel→right click on Copy→drag highlighted samples to the Collect window→Save text
5. Click "Save In" menu bar and select "My briefcase". Open the 2007 folder, type in file name and click Save. A message will appear saying the selected samples have been saved. Click OK (the sample names will disappear from the Collect window.
6. Open Excel. Then . . . Open→Look In "My Briefcase"→2007→at bottom, select "All Files (*.*)" in the "Files of Type" bar→find text file just saved and open→click thru the Text Import Wizard screens (next, next, finish)

Caliper Test Method

Caliper of a toilet tissue and/or fibrous structure ply is measured using a ProGage Thickness Tester (Thwing-Albert Instrument Company, West Berlin, NJ) with a pressure foot diameter of 5.08 cm (area of 6.45 cm$^2$) at a pressure of 14.73 g/cm$^2$. Four (4) samples are prepared by cutting of a usable unit such that each cut sample is at least 16.13 cm per side, avoiding creases, folds, and obvious defects. An individual specimen is placed on the anvil with the specimen centered underneath the pressure foot. The foot is lowered at 0.076 cm/sec to an applied pressure of 14.73 g/cm$^2$. The reading is taken after 3 sec dwell time, and the foot is raised. The measure is repeated in like fashion for the remaining 3 specimens. The caliper is calculated as the average caliper of the four specimens and is reported in mils (0.001 in) to the nearest 0.1 mils.

Dry Tensile Test Method: Elongation, Tensile Strength, TEA and Modulus

Elongation, Tensile Strength, TEA and Tangent Modulus are measured on a constant rate of extension tensile tester with computer interface (a suitable instrument is the EJA Vantage from the Thwing-Albert Instrument Co. Wet Berlin, NJ) using a load cell for which the forces measured are within 10% to 90% of the limit of the load cell. Both the movable (upper) and stationary (lower) pneumatic jaws are fitted with smooth stainless steel faced grips, with a design suitable for testing 1 inch wide sheet material (Thwing-Albert item #733GC). An air pressure of about 60 psi is supplied to the jaws.

Twenty usable units of fibrous structures are divided into four stacks of five usable units each. The usable units in each stack are consistently oriented with respect to machine direction (MD) and cross direction (CD). Two of the stacks are designated for testing in the MD and two for CD. Using a one inch precision cutter (Thwing Albert) take a CD stack and cut two, 1.00 in±0.01 in wide by at least 3.0 in long strips from each CD stack (long dimension in CD). Each strip is five usable unit layers thick and will be treated as a unitary specimen for testing. In like fashion cut the remaining CD stack and the two MD stacks (long dimension in MD) to give a total of 8 specimens (five layers each), four CD and four MD.

Program the tensile tester to perform an extension test, collecting force and extension data at an acquisition rate of 20 Hz as the crosshead raises at a rate of 4.00 in/min (10.16 cm/min) until the specimen breaks. The break sensitivity is set to 50%, i.e., the test is terminated when the measured force drops to 50% of the maximum peak force, after which the crosshead is returned to its original position.

Set the gage length to 2.00 inches. Zero the crosshead and load cell. Insert the specimen into the upper and lower open grips such that at least 0.5 inches of specimen length is contained each grip. Align specimen vertically within the upper and lower jaws, then close the upper grip. Verify specimen is aligned, then close lower grip. The specimen should be under enough tension to eliminate any slack, but less than 0.05 N of force measured on the load cell. Start the tensile tester and data collection. Repeat testing in like fashion for all four CD and four MD specimens.

Program the software to calculate the following from the constructed force (g) verses extension (in) curve:

Tensile Strength is the maximum peak force (g) divided by the product of the specimen width (1 in) and the number of usable units in the specimen (5), and then reported as g/in to the nearest 1 g/in.

Adjusted Gage Length is calculated to as the extension measured at 11.12 g of force (in) added to the original gage length (in).

Elongation is calculated as the extension at maximum peak force (in) divided by the Adjusted Gage Length (in) multiplied by 100 and reported as % to the nearest 0.1%.

Tensile Energy Absorption (TEA) is calculated as the area under the force curve integrated from zero extension to the extension at the maximum peak force (g*in), divided by the product of the adjusted Gage Length (in), specimen width (in), and number of usable units in the specimen (5). This is reported as g*in/in$^2$ to the nearest 1 g*in/in$^2$.

Replot the force (g) verses extension (in) curve as a force (g) verses strain curve. Strain is herein defined as the extension (in) divided by the Adjusted Gage Length (in).

Program the software to calculate the following from the constructed force (g) verses strain curve:

Tangent Modulus is calculated as the least squares linear regression using the first data point from the force (g) verses strain curve recorded after 190.5 g (38.1 g×5 layers) force and the 5 data points immediately preceding and the 5 data points immediately following it. This slope is then divided by the product of the specimen width (2.54 cm) and the number of usable units in the specimen (5), and then reported to the nearest 1 g/cm.

The Tensile Strength (g/in), Elongation (%), TEA (g*in/in$^2$) and Tangent Modulus (g/cm) are calculated for the four CD specimens and the four MD specimens. Calculate an average for each parameter separately for the CD and MD specimens.

Calculations:

Geometric Mean Tensile=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA (g*in/in$^2$)×CD TEA (g*in/in$^2$)]

Geometric Mean Modulus=Square Root of [MD Modulus (g/cm)×CD Modulus (g/cm)]

Total Dry Tensile Strength (TDT)=MD Tensile Strength (g/in)+CD Tensile Strength (g/in)

Total TEA=MD TEA (g*in/in$^2$)+CD TEA (g*in/in$^2$)

Total Modulus=MD Modulus (g/cm)+CD Modulus (g/cm)

Tensile Ratio=MD Tensile Strength (g/in)/CD Tensile Strength (g/in)

Wet Tensile Test Method

Wet tensile for a toilet tissue and/or fibrous structure ply is measured according to ASTM D829-97 for "Wet Tensile Breaking Strength of Paper and Paper Products, specifically by method 11.2 "Test Method B—Finch Procedure." Wet tensile is reported in units of "g/in". Initial Total Wet Tensile is measured immediately after saturation Wet Decay Test Method Wet decay (loss of wet tensile) for a toilet tissue and/or fibrous structure ply is measured according to the Wet Tensile Test Method and is the wet tensile of the toilet tissue and/or fibrous structure ply after it has been standing in the soaked condition in the Finch Cup for 30 minutes. Wet decay is reported in units of "%". Wet decay is the % loss of Initial Total Wet Tensile after the 30 minute soaking.

Flexural Rigidity Test Method

The Flexural Rigidity Test Method determines the overhang length of the present invention based on the cantilever beam principal. The distance a strip of sample can be extended beyond a flat platform before it bends through a specific angle is measured. The inter-action between sheet weight and sheet stiffness measured as the sheet bends or drapes under its own weight through the given angle under specified test conditions is used to calculate the sample Bend Length, Flexural Rigidity, and Bending Modulus.

The method is performed by cutting rectangular strips of samples of the fibrous structure to be tested, in both the cross direction and the machine direction. The Basis Weight of the sample is determined and the Dry Caliper of the samples is measured (as detailed previously). The sample is placed on a test apparatus that is leveled so as to be perfectly horizontal (ex: with a bubble level) and the short edge of the sample is aligned with the test edge of the apparatus. The sample is gently moved over the edge of the apparatus until it falls under its own weight to a specified angle. At that point, the length of sample overhanging the edge of the instrument is measured.

The apparatus for determining the Flexural Rigidity of fibrous structures is comprised of a rectangular sample support with a micrometer and fixed angle monitor. The sample support is comprised of a horizontal plane upon which the sample rectangle can comfortably be supported without any interference at the start of the test. As it is slowly pushed over the edge of the apparatus, it will bend until it breaks the plane of the fixed angle monitor, at which point the micrometer measures the length of overhang.

Eight samples of 25.4 mm×101.5 mm−152.0 mm are cut in the machine direction (MD); eight more samples of the same size are cut in the cross direction (CD). It is important that adjacent cuts are made exactly perpendicular to each other so that each angle is exactly 90 degrees. Samples are arranged such that the same surface is facing up. Four of the MD samples are overturned and four of the CD samples are overturned and marks are made at the extreme end of each, such that four MD samples will be tested with one side facing up and the other four MD samples will be tested with the other side facing up. The same is true for the CD samples with four being tested with one side up and four with the other side facing up.

A sample is then centered in a channel on the horizontal plane of the apparatus with one short edge exactly aligned with the edge of the apparatus. The channel is slightly oversized for the sample that was cut and aligns with the orientation of the rectangular support, such that the sample does not contact the sides of the channel. A lightweight slide bar is lowered over the sample resting in the groove such that the bar can make good contact with the sample and push it forward over the edge of the apparatus. The leading edge of the slide bar is also aligned with the edge of the apparatus and completely covers the sample. The micrometer is aligned with the slide bar and measures the distance the slide bar, thus the sample, advances.

From the back edge of the slide bar, the bar and sample are pushed forward at a rate of approximately 8-13 cm per second until the leading edge of the sample strip bends down and breaks the plane of the fixed angle measurement, set to 45°. At this point, the measurement for overhang is made by reading the micrometer to the nearest 0.5 mm and is reported in units of cm.

The procedure is repeated for each of the 15 remaining samples of the fibrous structure.

Calculations:

Flexural Rigidity is calculated from the overhang length as follows:

Bend Length=Overhang length/2

Where overhang length is the average of the 16 results collected.

The calculation for Flexural Rigidity (G) is:

$$G=0.1629*W*C^3(\text{mg·cm})$$

Where W is the sample basis weight in pounds/3000 $ft^2$ and C is the bend length in cm. The constant 0.1629 converts units to yield Flexural Rigidity (G) in units of milligram·cm.

Bending Modulus ($Q$)=Flexural Rigidity ($G$)/Moment of Inertia ($I$) per unit area.

$$Q = G/I$$

$$Q = \frac{732 * G}{\text{Caliper (mils)}^3}$$

Plate Stiffness Test Method

As used herein, the "Plate Stiffness" test is a measure of stiffness of a flat sample of a toilet tissue and/or fibrous structure ply as it is deformed downward into a hole beneath the sample. For the test, the sample is modeled as an infinite plate with thickness "t" that resides on a flat surface where it is centered over a hole with radius "R". A central force "F" applied to the tissue directly over the center of the hole deflects the tissue down into the hole by a distance "w". For a linear elastic material, the deflection can be predicted by:

$$w = \frac{3F}{4\pi Et^3}(1-v)(3+v)R^2$$

where "E" is the effective linear elastic modulus, "v" is the Poisson's ratio, "R" is the radius of the hole, and "t" is the thickness of the tissue, taken as the caliper in millimeters measured on a stack of 4 or 5 tissues under a load of about 0.29 psi. Taking Poisson's ratio as 0.1 (the solution is not highly sensitive to this parameter, so the inaccuracy due to the assumed value is likely to be minor), the previous equation can be rewritten for "w" to estimate the effective modulus as a function of the flexibility test results:

$$E \approx \frac{3R^2}{4t^3}\frac{F}{w}$$

The test results are carried out using an MTS Alliance RT/1, Insight Renew, or similar model testing machine (MTS Systems Corp., Eden Prairie, Minn.), with a 50 newton load cell, and data acquisition rate of at least 25 force points per second. As a stack of four tissue sheets (created without any bending, pressing, or straining) at least 2.5-inches by 2.5 inches, but no more than 5.0 inches by 5.0 inches, oriented in the same direction, sits centered over a hole of radius 15.75 mm on a support plate, a blunt probe of 3.15 mm radius descends at a speed of 20 mm/min. When the probe tip descends to 1 mm below the plane of the support plate, the test is terminated. The maximum slope (using least squares regression) in grams of force/mm over any 0.5 mm span during the test is recorded (this maximum slope generally occurs at the end of the stroke). The load cell monitors the applied force and the position of the probe tip relative to the plane of the support plate is also monitored. The peak load is recorded, and "E" is estimated using the above equation.

Calculations:

The Plate Stiffness "S" per unit width can then be calculated as:

$$S = \frac{Et^3}{12}$$

and is expressed in units of Newtons*millimeters. The Testworks program uses the following formula to calculate stiffness (or can be calculated manually from the raw data output):

$$S = \left(\frac{F}{w}\right)\left[\frac{(3+v)R^2}{16\pi}\right]$$

wherein "F/w" is max slope (force divided by deflection), "v" is Poisson's ratio taken as 0.1, and "R" is the ring radius.

The same sample stack (as used above) is then flipped upside down and retested in the same manner as previously described. This test is run three more times (with the different sample stacks). Thus, eight S values are calculated from four 4-sheet stacks of the same sample. The numerical average of these eight S values is reported as Plate Stiffness for the sample.

Plate Stiffness, Basis Weight Normalized is the quotient of the Average Plate Stiffness, S, in Nmm and the Basis Weight, in grams per square meter (gsm), per the Basis Weight Test Method.

$$\text{Plate Stiffness, } BW \text{ Normalized} = \frac{\text{Avg Plate Stiffness, } 'S'(N*\text{mm})}{BW\ (\text{gsm})}$$

$$\text{Plate Stiffness, } BW \text{ Normalized} = \frac{\text{Avg Plate Stiffness, } 'S'(N*\text{mm})}{BW\ (\text{gsm})}$$

Roll Compressibility Test Method

Figure 9:
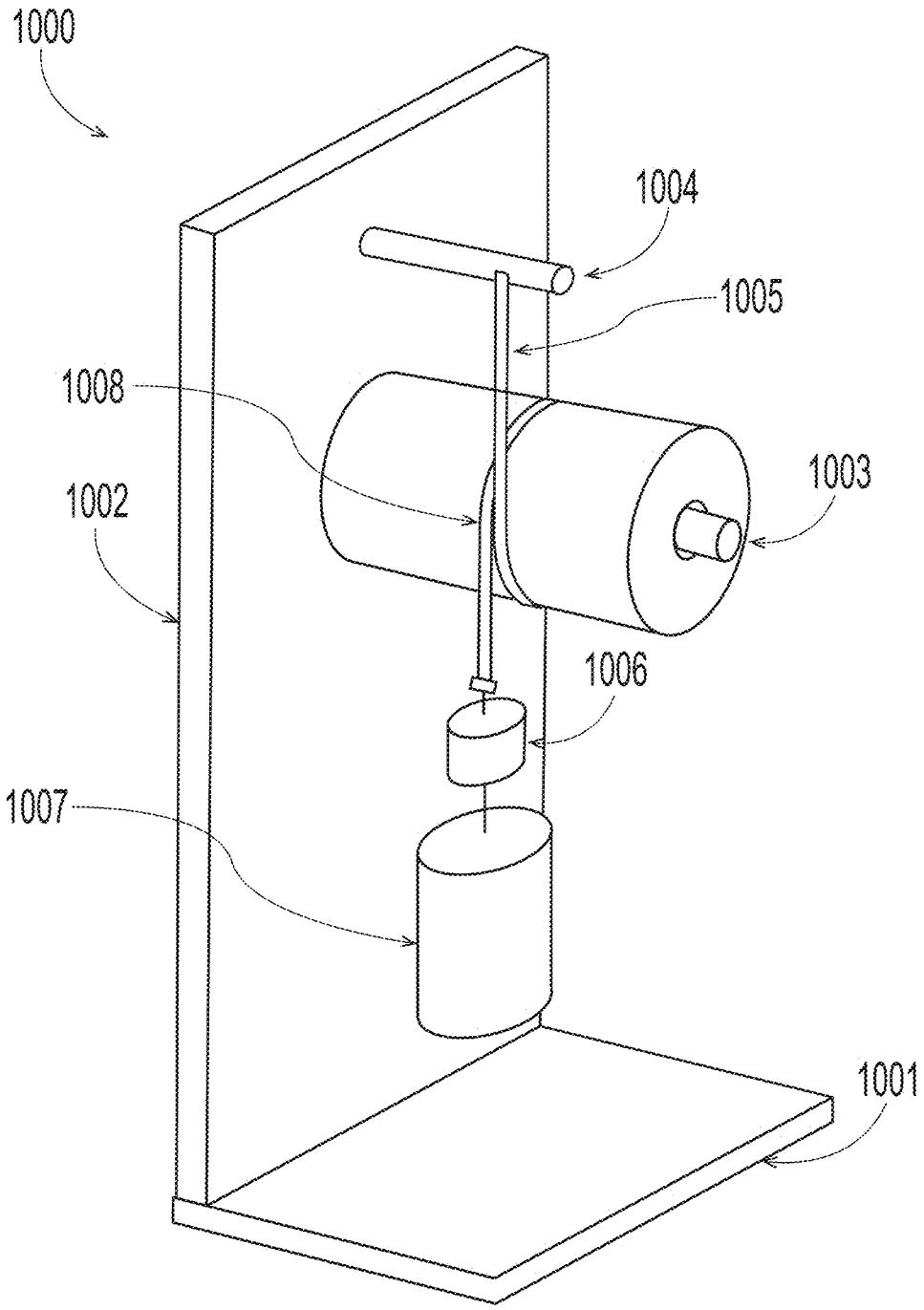
FIG. 9 is a schematic representation of the Roll Compressibility Test Method equipment and set-up.

Roll Compressibility (Percent Compressibility) is determined using the Roll Diameter Tester 1000 as shown in FIG. 9. It is comprised of a support stand made of two aluminum plates, a base plate 1001 and a vertical plate 1002 mounted perpendicular to the base, a sample shaft 1003 to mount the test roll, and a bar 1004 used to suspend a precision diameter tape 1005 that wraps around the circumference of the test roll. Two different weights 1006 and 1007 are suspended from the diameter tape to apply a confining force during the uncompressed and compressed measurement. All testing is performed in a conditioned room maintained at about 23° C.±2° C. and about 50%±2% relative humidity.

The diameter of the test roll is measured directly using a Pi® tape or equivalent precision diameter tape (e.g. an Executive Diameter tape available from Apex Tool Group, LLC, Apex, NC, Model No. W606PD) which converts the circumferential distance into a diameter measurement so the roll diameter is directly read from the scale. The diameter tape is graduated to 0.01 inch increments with accuracy certified to 0.001 inch and traceable to NIST. The tape is 0.25 in wide and is made of flexible metal that conforms to the curvature of the test roll but is not elongated under the 1100 g loading used for this test. If necessary the diameter tape is shortened from its original length to a length that allows both of the attached weights to hang freely during the test, yet is still long enough to wrap completely around the test roll being measured. The cut end of the tape is modified to allow for hanging of a weight (e.g. a loop). All weights used are calibrated, Class F hooked weights, traceable to NIST.

The aluminum support stand is approximately 600 mm tall and stable enough to support the test roll horizontally throughout the test. The sample shaft 1003 is a smooth aluminum cylinder that is mounted perpendicularly to the vertical plate 1002 approximately 485 mm from the base. The shaft has a diameter that is at least 90% of the inner diameter of the roll and longer than the width of the roll. A small steel bar 1004 approximately 6.3 mm diameter is mounted perpendicular to the vertical plate 1002 approximately 570 mm from the base and vertically aligned with the sample shaft. The diameter tape is suspended from a point along the length of the bar corresponding to the midpoint of a mounted test roll. The height of the tape is adjusted such that the zero mark is vertically aligned with the horizontal midline of the sample shaft when a test roll is not present.

Condition the samples at about 23° C.±2° C. and about 50%±2% relative humidity for 2 hours prior to testing. Rolls with cores that are crushed, bent or damaged should not be tested. Place the test roll on the sample shaft 1003 such that the direction the paper was rolled onto its core is the same direction the diameter tape will be wrapped around the test roll. Align the midpoint of the roll's width with the suspended diameter tape. Loosely loop the diameter tape 1004 around the circumference of the roll, placing the tape edges directly adjacent to each other with the surface of the tape lying flat against the test sample. Carefully, without applying any additional force, hang the 100 g weight 1006 from the free end of the tape, letting the weighted end hang freely without swinging. Wait 3 seconds. At the intersection of the diameter tape 1008, read the diameter aligned with the zero mark of the diameter tape and record as the Original Roll Diameter to the nearest 0.01 inches. With the diameter tape still in place, and without any undue delay, carefully hang the 1000 g weight 1007 from the bottom of the 100 g weight, for a total weight of 1100 g. Wait 3 seconds. Again read the roll diameter from the tape and record as the Compressed Roll Diameter to the nearest 0.01 inch. Calculate percent compressibility to the according to the following equation and record to the nearest 0.1%:

$$\%\ \text{Compressibility} = \frac{(\text{Original Roll Diameter}) - (\text{Compressed Roll Diameter})}{\text{Original Roll Diameter}} \times 100$$

Repeat the testing on 10 replicate rolls and record the separate results to the nearest 0.1%. Average the 10 results and report as the Percent Compressibility to the nearest 0.1%.

CRT Test Method

The absorption (wicking) of water by an absorbent fibrous structure (sample) is measured over time. A sample is placed horizontally in the instrument and is supported by an open weave net structure that rests on a balance. The test is initiated when a tube connected to a water reservoir is raised and the meniscus makes contact with the center of the sample from beneath, at a small negative pressure. Absorption is allowed to occur for 2 seconds after which the contact is broken and the cumulative rate for the first 2 seconds is calculated.

Apparatus

Conditioned Room—Temperature is controlled from 73° F.±2° F. (23° C.±1° C.). Relative Humidity is controlled from 50%±2%

Sample Preparation—Product samples are cut using hydraulic/pneumatic precision cutter into 7.62 cm diameter circles, at least 2.54 cm from any edge, cutting 2 replicates for each test.

Capacity Rate Tester (CRT)—The CRT is an absorbency tester capable of measuring capacity and rate. The CRT consists of a balance (0.001 g), on which rests on a woven grid (using nylon monofilament line having a 0.014" diameter) placed over a small reservoir with a delivery tube in the center. This reservoir is filled by the action of solenoid valves, which help to connect the sample supply reservoir to an intermediate reservoir, the water level of which is monitored by an optical sensor. The CRT is run with a −2 mm water column, controlled by adjusting the height of water in the supply reservoir.

Software—LabView based custom software specific to CRT Version 4.2 or later.

Water—Distilled water with conductivity <10 μS/cm (target <5 μS/cm) @25° C.

For this method, a usable unit is described as one finished product unit regardless of the number of plies. Condition all samples with packaging materials removed for a minimum of 2 hours prior to testing. Discard at least the first ten usable units from the roll. Remove two usable units and cut one 7.62 cm circular sample from the center of each usable unit for a total of 2 replicates for each test result. Do not test samples with defects such as wrinkles, tears, holes, etc. Replace with another usable unit which is free of such defects Pre-Test Set-Up 1. The water height in the reservoir tank is set −2.0 mm below the top of the support rack (where the sample will be placed).
2. The supply tube (8 mm I.D.) is centered with respect to the support net.
3. Test samples are cut into circles of 7.62 cm diameter and equilibrated at Tappi environment conditions for a minimum of 2 hours.

Test Description

1. After pressing the start button on the software application, the supply tube moves to 0.33 mm below the water height in the reserve tank. This creates a small meniscus of water above the supply tube to ensure test initiation. A valve between the tank and the supply tube closes, and the scale is zeroed.
2. The software prompts you to "load a sample". A sample is placed on the support net, centering it over the supply tube, and with the side facing the outside of the roll placed downward.
3. Close the balance windows, and press the "OK" button—the software records the dry weight of the circle.
4. The software prompts you to "place cover on sample". The plastic cover is placed on top of the sample, on top of the support net. The plastic cover has a center pin (which is flush with the outside rim) to ensure that the sample is in the proper position to establish hydraulic connection. Four other pins, 1 mm shorter in depth, are positioned 1.25-1.5 inches radially away from the center pin to ensure the sample is flat during the test. The sample cover rim should not contact the sheet. Close the top balance window and click "OK".
5. The software re-zeroes the scale and then moves the supply tube towards the sample. When the supply tube reaches its destination, which is 0.33 mm below the support net, the valve opens (i.e., the valve between the reserve tank and the supply tube), and hydraulic connection is established between the supply tube and the sample. Data acquisition occurs at a rate of 5 Hz, and is started about 0.4 seconds before water contacts the sample.

6. The test runs for 2 seconds. After this, the supply tube pulls away from the sample to break the hydraulic connection.
7. The wet sample is removed from the support net. Residual water on the support net and cover are dried with a paper towel.
8. Repeat until all samples are tested.
9. After each test is run, a *.txt file is created (typically stored in the CRT/data/rate directory) with a file name as typed at the start of the test. The file contains all the test set-up parameters, dry sample weight, and cumulative water absorbed (g) vs. time (sec) data collected from the test.
10. The software records the weight of water acquisition and the time and from this calculates the CRT Rate (g/sec) and the CRT Capacity (g/g, which is grams water/gram fibrous structure).

Weight Average Molecular Weight Test Method

The weight average molecular weight and the molecular weight distribution (MWD) are determined by Gel Permeation Chromatography (GPC) using a mixed bed column. The column (Waters linear ultrahydrogel, length/ID: 300× 7.8 mm) is calibrated with a narrow molecular weight distribution polysaccharide, 107,000 g/mol from Polymer Laboratories). The calibration standards are prepared by dissolving 0.024 g of polysaccharide and 6.55 g of the mobile phase in a scintillation vial at a concentration of 4 mg/ml. The solution sits undisturbed overnight. Then it is gently swirled and filtered with a 5 micron nylon syringe filter into an auto-sampler vial.

The filtered sample solution is taken up by the auto-sampler to flush out previous test materials in a 100 μL injection loop and inject the present test material into the column. The column is held at 50° C. using a Waters TCM column heater. The sample eluded from the column is measured against the mobile phase background by a differential refractive index detector (Wyatt Optilab REX interferometric refractometer) and a multi-angle later light scattering detector (Wyatt DAWN Heleos 18 angle laser light detector) held at 50° C. The mobile phase is water with 0.03M potassium phosphate, 0.2M sodium nitrate, and 0.02% sodium azide. The flowrate is set at 0.8 mL/min with a run time of 35 minutes.

Glide Test Method—3 Inch Sample

This test is designed to measure the adhesive characteristics between two different surfaces of a fibrous structure, for example toilet tissue (Dual Surface Glide Value) and a single surface of a fibrous structure, for example toilet tissue (Single Surface Glide Value).

One objective of this Glide Test Method is to quantify the Peak Load and Drag Force required for the one surface in a fibrous structure, for example toilet tissue, such as a surface material surface, to move across a different surface in the fibrous structure, for example toilet tissue, such as a web material surface, referred to as Dual Surface Glide Value.

Another objective of this Glide Test Method is to quantify the Peak load and Drag force required for the one surface in a fibrous structure, for example toilet tissue to move across the same surface in the fibrous structure, for example toilet tissue, such as a surface material surface, referred to as Single Surface Glide Value.

The Drag Force is determined by pulling about a 3" wide×12" long strip of a fibrous structure, for example a toilet tissue with a first surface over a different surface of about a 3" wide×16" long strip of the same fibrous structure, for example the same toilet tissue using a friction/peel tester.

This method is intended for use on toilet tissue and unconverted fibrous structure stock.

Figure 10:
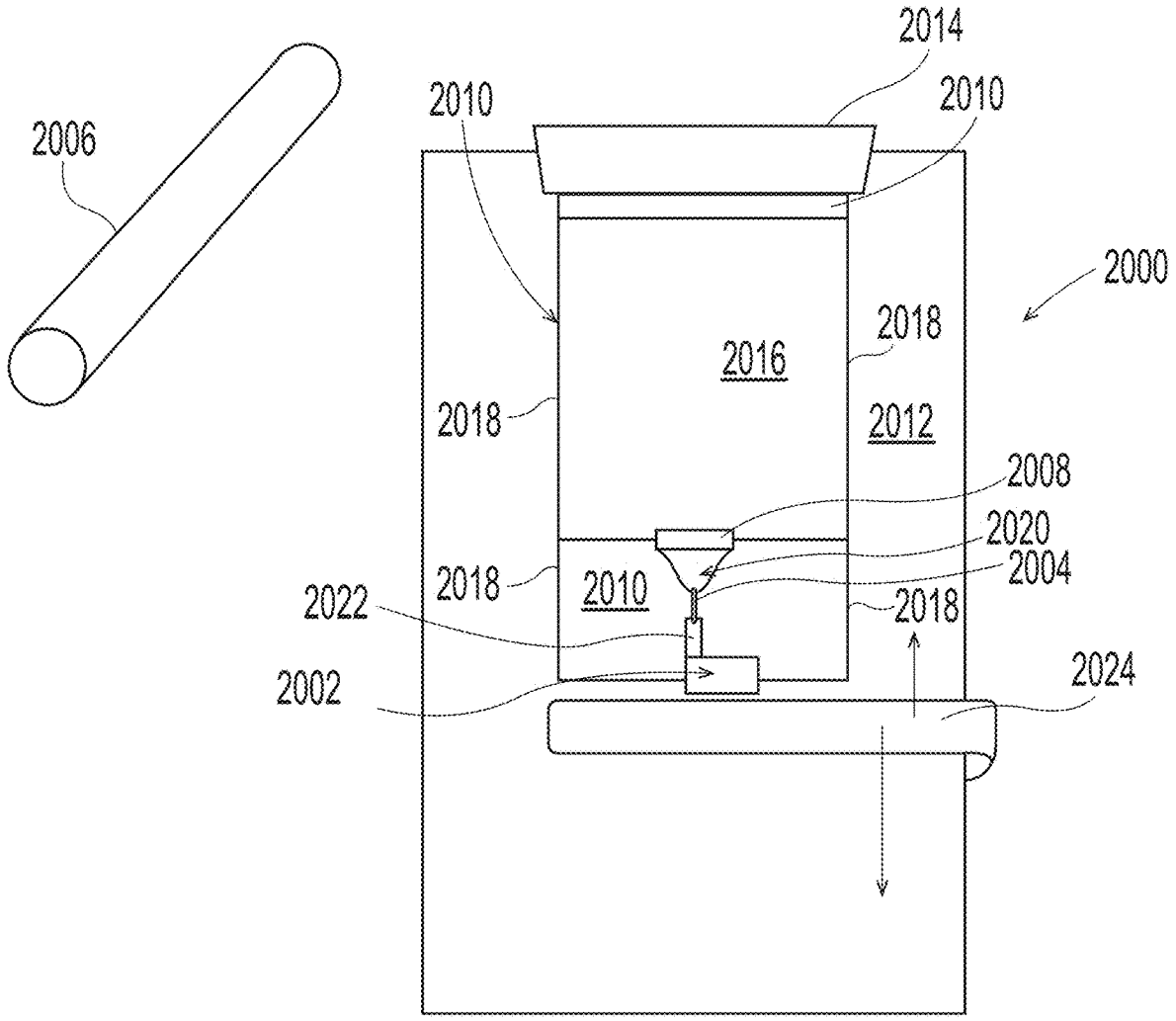
FIG. 10 is a schematic representation of the Glide Test Method—3 Inch Sample and 4 Inch Sample equipment and set-up.

Apparatus—FIG. 10

| | |
|---|---|
| Friction/Peel Tester 2000 | Thwing-Albert FP-2260 Friction/Peel Tester, 2000 g load cell 2002 |
| Sampling Rate | 60 Hz |
| Loadcell Mode | Tension |
| Loadcell Range | 100% |
| Pre-Test Load | 3 g |
| Return Speed | 1000 mm/min |
| Test Speed | 60 mm/min |
| Software | MAP 4, Version 4.3.12 or later |
| Tape | Scotch 1" Tape, or equivalent |
| Conditioned Room | Temperature and humidity controlled within the following limits:<br>For Laboratory:<br>Temperature: 73° F. ± 2° F. (23° C. ± 1° C.)<br>Relative humidity: 50% (±2%) |
| Sample Cutter | Scissors |
| Paper Cutter | Cutting Board, 24 in size |
| String 2004 | Ultracast Spiderwire 20 1b 0.0009" diameter |
| Metal Roller 2006 | Solid Aluminum Roll, 1⅞" diameter, 5⅛" long, 615 g mass |
| Binder Clip 2008 | ¾" Wide |

Sample Preparation

For this method, a sample of the fibrous structure, for example toilet tissue for testing may have one or more plies.

Condition the sample(s) with any wrapping or packaging material removed for a minimum of two hours in a room conditioned at 50% RH±2% and 73° F.±2° F. Do not use samples from paper with obvious defects such as creases, tears, holes, etc.

For Toilet Tissue, for Example Single- or Multi-Ply Toilet Tissue Roll:

Remove the outer 8-10 useable units from the toilet tissue roll to prevent testing materials that have been "handled." Then, carefully remove one strip of useable units from the toilet tissue roll such that about a 3" wide×16" long strip of toilet tissue is able to be cut from the strip of useable units. Cut about a 3" wide×16" long sample strip 2010 from the strip of useable units and place the sample strip 2010 on the surface 2012 of the sled of the Friction/Peel Tester 2000 with the outer side of the sample strip 2010 (consumer-contacting surface) facing up. Clamp one end of the sample strip 2010 using the built-in clamp 2014 at the beginning of the sled surface 2012.

For the Dual Surface Glide Value measurement, remove another strip of useable units from the same toilet tissue roll such that about a 3" wide×12" long strip of toilet tissue is able to be cut from the strip of useable units. Cut about a 3" wide×12" long sample strip 2016 from the strip of useable units and place the sample strip 2016 on top of the previously positioned sample strip 2010 already lying on the surface 2012 of the sled of the Friction/Peel Tester 2000 ensuring that the edges 2018 of both of the sample strips 2010 and 2016 line up perfectly (or as perfectly as possible in the case of product defects). The end of the top sample strip 2016 should be approximately one inch away from the built-in clamp 2014.

For the Dual Surface Glide Value measurement, the sample strips 2010 and 2016 are arranged such that different surfaces of the toilet tissue are in contact with one another for the test.

For the Single Surface Glide Value measurement, the sample strips are arranged such that the surfaces of the toilet tissue in contact with each other are the same.

Unconverted Stock:

To create the sample strip for clamping to the built-in clamp 2014 of the sled surface 2012 of the Fiction/Peel Tester, cut a stack (no more than 5 fibrous structures thick) of unconverted stock into strips of 16" long in the Machine Direction and 3" in the Cross Machine Direction. To create the sample strip for testing, cut a stack (no more than 5 fibrous structures thick) of unconverted stock into strips of 12" long in the Machine Direction and 3" in the Cross Machine Direction.

Place the sample strip for clamping on the built-in clamp (16" long in the Machine Direction) with the consumer-contacting surface, for example surface material surface facing up so that the machine direction faces left to right on the Friction/Peel Tester sled surface. Clamp this sample strip at the left side of the sled underneath the built-in clamp. Place the sample strip for testing (12" long in the Machine Direction) on top of the previously positioned sample strip already lying on the surface of the sled of the Friction/Peel Tester ensuring that the edges of both of the sample strips line up perfectly (or as perfectly as possible in the case of product defects). The end of the top sample strip should be approximately one inch away from the built-in clamp.

For the Dual Surface Glide Value measurement, the sample strips are arranged such that different surfaces of the unconverted stock are in contact with one another for the test. For the Single Surface Glide Value measurement, the sample strips are arranged such that the surfaces of the unconverted stock in contact with each other are the same.

Operation

Using a length of string 2004, for example Spiderwire line, loop the string 2004 through one of the "eyes" 2020 of the binder clip 2008 and through the probe 2022 of the load cell 2002. Tie off the string 2004 so that the total length of the loop is 1" while the loop holds the binder clip 2008 to the probe 2022 of the load cell 2002. Gently set the binder clip 2008, now tied to the probe 2022, so that the binder clip 2008 gently rests on the load cell 2002 (not the probe 2022) so that the string 2004 that holds the binder clip 2008 is completely slack. Zero the load cell 2002.

Move the crosshead 2024 towards the built-in clamp 2014 so that the binder clip 2008 may attach to the right end of the top sample strip 2016 without pulling on the probe 2022 (the string 2004 is slack). If unconverted stock is being tested, tape the right edge of the top sample strip to prevent the sample strip from tearing if the static force may be stronger than the tensile force of the sample strip. If the sample strip tears, discard the data for the sample strip and repeat with a new sample strip.

Line up the sample strip 2016 so that the binder clip 2008, the probe 2022 tip, and the side closest to the built-in clamp 2014 of the sample strip 2016 all form a straight line and are "parallel" to one another. This is done to prevent the sample strip 2016 from being pulled at an angle, rather than along the length of the bottom sample strip 2010.

Gently position the metal roller 2006 at the left side of the top sample strip 2016 closest to the built-in clamp 2014. The bottom of the metal roller 2006 should not yet be on the top sample strip 2016. Roll the metal roller 2006 from left to right so that the metal roller 2006 comes to rest when it makes contact with the binder clip 2008, taking care not to press down on the metal roller 2006 during the rolling. The roll time of the metal roller 2006 should be 3-5 seconds from start to finish. Do not roll the metal roller 2006 back and forth over the sample strip 2016, as this will cause additional bonding. If obvious defects such as large wrinkles form, discard the sample strip and repeat the test with another sample strip.

Select the yellow "Pre-Test" button. This will pull the slack out of the string 2004 and add 3 g tension to the load cell 2002. Before proceeding, confirm that the probe 2022 tip, the eye 2020 of the binder clip 2008, and the middle of the sample strip 2016 all form a straight line as mentioned previously.

Begin the test. Monitor the Friction/Peel Tester 2000 for any signs of slippage from the binder clip 2008 when at high tensile force, especially when using tape. If slippage occurs, discard the data for the sample strip 2016 and repeat with a new sample strip 2016. When the test completes, the cross-head 2024 will move back to its home condition. To avoid any unintentional damage to the probe 2022, be sure to unclamp the sample strip 2016 and return the binder clip 2008 to the top of the load cell 2002 (or hold the binder clip 2008) until the crosshead 2024 stops moving.

Run a total of 5 replicates by repeating the entire test method each time.

Calculations

Peak Load=sum of max force readings/number of replicates tested; namely 5 replicates.

Drag Force=average of the load cell values from the 20 mm point to the 40 mm point of the pulling distance, even though the sample strip is pulled a total of 40 mm. This Drag Force is reported in units of g to the nearest 0.1 g. The reported Dual Surface Glide Value and the Single Surface Glide Value are the average of their respective Drag Forces for 5 replicates and are reported in units of g to the nearest 0.1 g.

Glide Test Method—4 Inch Sample

This test is designed to measure the adhesive characteristics between two different surfaces of a fibrous structure, for example toilet tissue (Dual Surface Glide Value) and a single surface of a fibrous structure, for example toilet tissue (Single Surface Glide Value).

One objective of this Glide Test is to quantify the peak load and drag force required for the one surface in a fibrous structure, for example toilet tissue, such as a surface material surface, to move across a different surface in the fibrous structure, for example toilet tissue, such as a web material surface, referred to as Dual Surface Glide Value.

Another objective of this Glide Test is to quantify the peak load and drag force required for the one surface in a fibrous structure, for example toilet tissue to move across the same surface in the fibrous structure, for example toilet tissue, such as a surface material surface, referred to as Single Surface Glide Value.

The drag force is determined by pulling about a 4" wide×12" long strip of a fibrous structure, for example a toilet tissue with a first surface over a different surface of about a 4" wide×16" long strip of the same fibrous structure, for example the same toilet tissue using a friction/peel tester.

This method is intended for use on toilet tissue and unconverted fibrous structure stock.

Apparatus—FIG. 10

| | |
|---|---|
| Friction/Peel Tester 2000 | Thwing-Albert FP-2260 Friction/Peel Tester, 2000 g load cell 2002 |
| Sampling Rate | 60 Hz |
| Loadcell Mode | Tension |
| Loadcell Range | 100% |
| Pre-Test Load | 3 g |
| Return Speed | 1000 mm/min |
| Test Speed | 60 mm/min |
| Software | MAP 4, Version 4.3.12 or later |
| Tape | Scotch 1" Tape, or equivalent |
| Conditioned Room | Temperature and humidity controlled within the following limits:<br>For Laboratory:<br>Temperature: 73° F. ± 2° F. (23° C. ± 1° C.)<br>Relative humidity: 50% (±2%) |
| Sample Cutter | Scissors, 4 in or larger |
| Paper Cutter | Cutting Board, 24 in size |
| String 2004 | Ultracast Spiderwire 20 1b 0.0009" diameter |
| Metal Roller 2006 | Solid Aluminum Roll, 1⅞" diameter, 5⅛" long, 615 g mass |
| Binder Clip 2008 | ¾" Wide |

Sample Preparation

For this method, a sample of the fibrous structure, for example toilet tissue for testing may have one or more plies.

Condition the sample(s) with any wrapping or packaging material removed for a minimum of two hours in a room conditioned at 50% RH±2% and 73° F.±2° F. Do not use samples from paper with obvious defects such as creases, tears, holes, etc.

For Toilet Tissue, for Example Single- or Multi-Ply Toilet Tissue Roll:

Remove the outer 8-10 useable units from the toilet tissue roll to prevent testing materials that have been "handled." Then, carefully remove one strip of useable units from the toilet tissue roll such that about a 4" wide×16" long strip of toilet tissue is able to be cut from the strip of useable units. Cut about a 4" wide×16" long sample strip 2010 from the strip of useable units and place the sample strip 2010 on the surface 2012 of the sled of the Friction/Peel Tester 2000 with the outer side of the sample strip 2010 (consumer-contacting surface) facing up. Clamp one end of the sample strip 2010 using the built-in clamp 2014 at the beginning of the sled surface 2012.

For the Dual Surface Glide Value measurement, remove another strip of useable units from the same toilet tissue roll such that about a 4" wide×12" long strip of toilet tissue is able to be cut from the strip of useable units. Cut about a 4" wide×12" long sample strip 2016 from the strip of useable units and place the sample strip 2016 on top of the previously positioned sample strip 2010 already lying on the surface 2012 of the sled of the Friction/Peel Tester 2000 ensuring that the edges 2018 of both of the sample strips 2010 and 2016 line up perfectly (or as perfectly as possible in the case of product defects). The end of the top sample strip 2016 should be approximately one inch away from the built-in clamp 2014.

For the Dual Surface Glide Value measurement, the sample strips 2010 and 2016 are arranged such that different surfaces of the toilet tissue are in contact with one another for the test. For the Single Surface Glide Value measurement, the sample strips are arranged such that the surfaces of the toilet tissue in contact with each other are the same.

Unconverted Stock:

To create the sample strip for clamping to the built-in clamp 2014 of the sled surface 2012 of the Fiction/Peel Tester, cut a stack (no more than 5 fibrous structures thick) of unconverted stock into strips of 16" long in the Machine Direction and 4" in the Cross Machine Direction. To create the sample strip for testing, cut a stack (no more than 5 fibrous structures thick) of unconverted stock into strips of 12" long in the Machine Direction and 4" in the Cross Machine Direction.

Place the sample strip for clamping on the built-in clamp (16" long in the Machine Direction) with the consumer-contacting surface, for example surface material surface facing up so that the machine direction faces left to right on the Friction/Peel Tester sled surface. Clamp this sample strip at the left side of the sled underneath the built-in clamp. Place the sample strip for testing (12" long in the Machine Direction) on top of the previously positioned sample strip already lying on the surface of the sled of the Friction/Peel Tester ensuring that the edges of both of the sample strips line up perfectly (or as perfectly as possible in the case of product defects). The end of the top sample strip should be approximately one inch away from the built-in clamp.

For the Dual Surface Glide Value measurement, the sample strips are arranged such that different surfaces of the unconverted stock are in contact with one another for the test. For the Single Surface Glide Value measurement, the sample strips are arranged such that the surfaces of the unconverted stock in contact with each other are the same.

Operation

Using a length of string 2004, for example Spiderwire line, loop the string 2004 through one of the "eyes" 2020 of the binder clip 2008 and through the probe 2022 of the load cell 2002. Tie off the string 2004 so that the total length of the loop is 1" while the loop holds the binder clip 2008 to the probe 2022 of the load cell 2002. Gently set the binder clip 2008, now tied to the probe 2022, so that the binder clip 2008 gently rests on the load cell 2002 (not the probe 2022) so that the string 2004 that holds the binder clip 2008 is completely slack. Zero the load cell 2002.

Move the crosshead 2024 towards the built-in clamp 2014 so that the binder clip 2008 may attach to the right end of the top sample strip 2016 without pulling on the probe 2022 (the string 2004 is slack). If unconverted stock is being tested, tape the right edge of the top sample strip to prevent the sample strip from tearing if the static force may be stronger than the tensile force of the sample strip. If the sample strip tears, discard the data for the sample strip and repeat with a new sample strip.

Line up the sample strip 2016 so that the binder clip 2008, the probe 2022 tip, and the side closest to the built-in clamp 2014 of the sample strip 2016 all form a straight line and are "parallel" to one another. This is done to prevent the sample strip 2016from being pulled at an angle, rather than along the length of the bottom sample strip 2010.

Gently position the metal roller 2006 at the left side of the top sample strip 2016 closest to the built-in clamp 2014. The bottom of the metal roller 2006 should not yet be on the top sample strip 2016. Roll the metal roller 2006 from left to right so that the metal roller 2006 comes to rest when it makes contact with the binder clip 2008, taking care not to press down on the metal roller 2006 during the rolling. The roll time of the metal roller 2006 should be 3-5 seconds from start to finish. Do not roll the metal roller 2006 back and forth over the sample strip 2016, as this will cause additional bonding. If obvious defects such as large wrinkles form, discard the sample strip and repeat the test with another sample strip.

Select the yellow "Pre-Test" button. This will pull the slack out of the string 2004 and add 3 g tension to the load cell 2002. Before proceeding, confirm that the probe 2022 tip, the eye 2020 of the binder clip 2008, and the middle of the sample strip 2016 all form a straight line as mentioned previously.

Begin the test. Monitor the Friction/Peel Tester 2000 for any signs of slippage from the binder clip 2008 when at high tensile force, especially when using tape. If slippage occurs, discard the data for the sample strip 2016 and repeat with a new sample strip 2016. When the test completes, the crosshead 2024 will move back to its home condition. To avoid any unintentional damage to the probe 2022, be sure to unclamp the sample strip 2016 and return the binder clip 2008 to the top of the load cell 2002 (or hold the binder clip 2008) until the crosshead 2024 stops moving.

Run a total of 5 replicates by repeating the entire test method each time.

Calculations

Peak Load=sum of max force readings/number of replicates tested; namely 5 replicates.

Drag Force=average of the load cell values from the 20 mm point to the 40 mm point of the pulling distance, even though the sample strip is pulled a total of 40 mm. This Drag Force is reported in units of g to the nearest 0.1 g. The reported Dual Surface Glide Value and the Single Surface Glide Value are the average of their respective Drag Forces for 5 replicates and are reported in units of g to the nearest 0.1 g.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A layered fibrous structure comprising:

a. a first layer comprising a wet laid fibrous structure having a plurality of fibrous elements, wherein the first layer comprises a consumer-contacting surface;

b. a second layer comprising a plurality of filaments spun directly onto the consumer-contacting surface of the first layer, wherein the plurality of filaments are present on the consumer-contacting surface of the first layer at a basis weight of 2.5 gsm or less; and c. a surface softening composition present on at least a portion of the plurality of filaments.

2. The layered fibrous structure according to claim 1 wherein the plurality of fibrous elements comprise a plurality of fibers.

3. The layered fibrous structure according to claim 2 wherein the plurality of fibers comprise a plurality of pulp fibers.

4. The layered fibrous structure according to claim 1 wherein the wet laid fibrous structure is a structured fibrous structure.

5. The layered fibrous structure according to claim 1 wherein the wet laid fibrous structure is a through-air-dried fibrous structure.

6. The layered fibrous structure according to claim 5 wherein the through-air-dried fibrous structure is an uncreped, through-air-dried fibrous structure.

7. The layered fibrous structure according to claim 5 wherein the through-air-dried fibrous structure is a creped, through-air-dried fibrous structure.

8. The layered fibrous structure according to claim 1 wherein the wet laid fibrous structure is a fabric-creped fibrous structure.

9. The layered fibrous structure according to claim 1 wherein the wet laid fibrous structure is a belt-creped fibrous structure.

10. The layered fibrous structure according to claim 1 wherein the wet laid fibrous structure exhibits substantially uniform density.

11. The layered fibrous structure according to claim 1 wherein the wet laid fibrous structure exhibits differential density.

12. The layered fibrous structure according to claim 1 wherein the wet laid fibrous structure comprises a surface pattern.

13. The fibrous structure according to claim 1 wherein the wet laid fibrous structure comprises a conventional wet-pressed fibrous structure.

14. The layered fibrous structure according to claim 1 wherein the plurality of filaments of the second layer comprise a hydroxyl polymer.

15. The layered fibrous structure according to claim 14 wherein the hydroxyl polymer comprises polyvinyl alcohol.

16. The layered fibrous structure according to claim 14 wherein the hydroxyl polymer comprises a polysaccharide.

17. The layered fibrous structure according to claim 1 wherein the plurality of filaments exhibit an average diameter of less than 6 μm as measured according to the Average diameter Test Method.

* * * * *